US011964838B2

(12) United States Patent
Asano et al.

(10) Patent No.: US 11,964,838 B2
(45) Date of Patent: Apr. 23, 2024

(54) PRINTING APPARATUS

(71) Applicant: CANON KABUSHIKI KAISHA, Tokyo (JP)

(72) Inventors: Shinya Asano, Tokyo (JP); Takeshi Koda, Kanagawa (JP); Toshiro Sugiyama, Kanagawa (JP); Waichiro Saiki, Kanagawa (JP); Tomohiro Suzuki, Kanagawa (JP); Ryo Kobayashi, Kanagawa (JP); Tomoyuki Nagase, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 38 days.

(21) Appl. No.: 17/528,412

(22) Filed: Nov. 17, 2021

(65) Prior Publication Data

US 2022/0169470 A1 Jun. 2, 2022

(30) Foreign Application Priority Data

Nov. 27, 2020 (JP) ..... 2020-197309

(51) Int. Cl.
*B65H 29/58* (2006.01)
*B65H 29/60* (2006.01)

(52) U.S. Cl.
CPC ..... *B65H 29/60* (2013.01); *B65H 2404/632* (2013.01); *B65H 2801/21* (2013.01)

(58) Field of Classification Search
CPC ..... B65H 29/60; B65H 29/58; B65H 29/62; B65H 2301/133; B65H 2404/632; B65H 2601/321; B65H 2402/441; G03G 21/1633; G03G 2215/00544
See application file for complete search history.

(56) References Cited

U.S. PATENT DOCUMENTS

| | | | |
|---|---|---|---|
| 5,592,280 | A | 1/1997 | Ishizuka et al. |
| 5,742,301 | A | 4/1998 | Ikeda |
| 6,731,903 | B2 | 5/2004 | Suzuki |
| 6,845,228 | B2 | 1/2005 | Suzuki et al. |
| 2003/0193135 | A1 | 10/2003 | Suzuki |
| 2006/0181590 | A1 | 8/2006 | Nonaka |
| 2006/0214351 | A1 | 9/2006 | Watanabe |

(Continued)

FOREIGN PATENT DOCUMENTS

| | | | |
|---|---|---|---|
| JP | 01176747 A | * | 7/1989 |
| JP | 09136744 A | * | 5/1997 |
| JP | 4243343 B2 | | 3/2009 |

OTHER PUBLICATIONS

Extended European Search Report dated Mar. 24, 2022, in European Patent Application No. 21207221.9.

*Primary Examiner* — Luis A Gonzalez
(74) *Attorney, Agent, or Firm* — Venable LLP

(57) ABSTRACT

A printing apparatus includes a printing unit configured to print an image on a sheet; a first exit path from which the sheet with the image printed thereon by the printing unit is discharged while being reversed; a second exit path from which the sheet with the image printed thereon by the printing unit is discharged without being reversed; and a switch member configured to be pivotably arranged so as to switch between the first exit path and the second exit path. The first exit path passes above a pivot center of the switch member, and the second exit path passes below the pivot center.

16 Claims, 23 Drawing Sheets

(56) References Cited

U.S. PATENT DOCUMENTS

| | | | | |
|---|---|---|---|---|
| 2011/0064497 | A1* | 3/2011 | Niihara | G03G 15/6517 399/363 |
| 2011/0114691 | A1* | 5/2011 | Morinaga | G03G 21/1638 226/102 |
| 2011/0211210 | A1* | 9/2011 | Niihara | H04N 1/00588 358/1.12 |
| 2015/0328906 | A1* | 11/2015 | Sumioka | B65H 16/02 242/564.5 |
| 2022/0105738 | A1* | 4/2022 | Murata | B41J 15/02 |
| 2022/0169477 | A1* | 6/2022 | Fukui | B65H 29/125 |

* cited by examiner

PRINTING APPARATUS

BACKGROUND OF THE INVENTION

Field of the Invention

The present invention relates to a printing apparatus.

Description of the Related Art

As a printing apparatus represented by a large format inkjet printer, there is known a printing apparatus that performs printing on a roll sheet. In such a printing apparatus, a basket is arranged in the lower portion of the apparatus and a printed cut sheet is discharged to the basket. However, the storage amount of the basket is limited. Therefore, there has been also proposed a printing apparatus that is provided with a tray, on which a discharged sheet is stacked, separately from the basket, and configured to be switchable between discharge to the basket and discharge to the tray. Japanese Patent No. 4243343 discloses a printing apparatus including a plurality of exit paths for discharging sheets, in which a switch member can selectably switch the exit paths.

In the printing apparatus including the plurality of exit paths, it is necessary to ensure a space for the switch member in addition to ensurance of a space for each exit path. Thus, the apparatus tends to be large.

SUMMARY OF THE INVENTION

The present invention provides a printing apparatus having a configuration for switching a plurality of exit paths, in which downsizing can be achieved.

According to one aspect of the present invention, there is provided a printing apparatus comprising: a printing unit configured to print an image on a sheet; a first exit path from which the sheet with the image printed thereon by the printing unit is discharged while being reversed; a second exit path from which the sheet with the image printed thereon by the printing unit is discharged without being reversed; and a switch member configured to be pivotably arranged so as to switch the first exit path and the second exit path, wherein the first exit path passes above a pivot center of the switch member, and the second exit path passes below the pivot center.

Further features of the present invention will become apparent from the following description of exemplary embodiments (with reference to the attached drawings).

DESCRIPTION OF THE EMBODIMENTS

Figure 1:
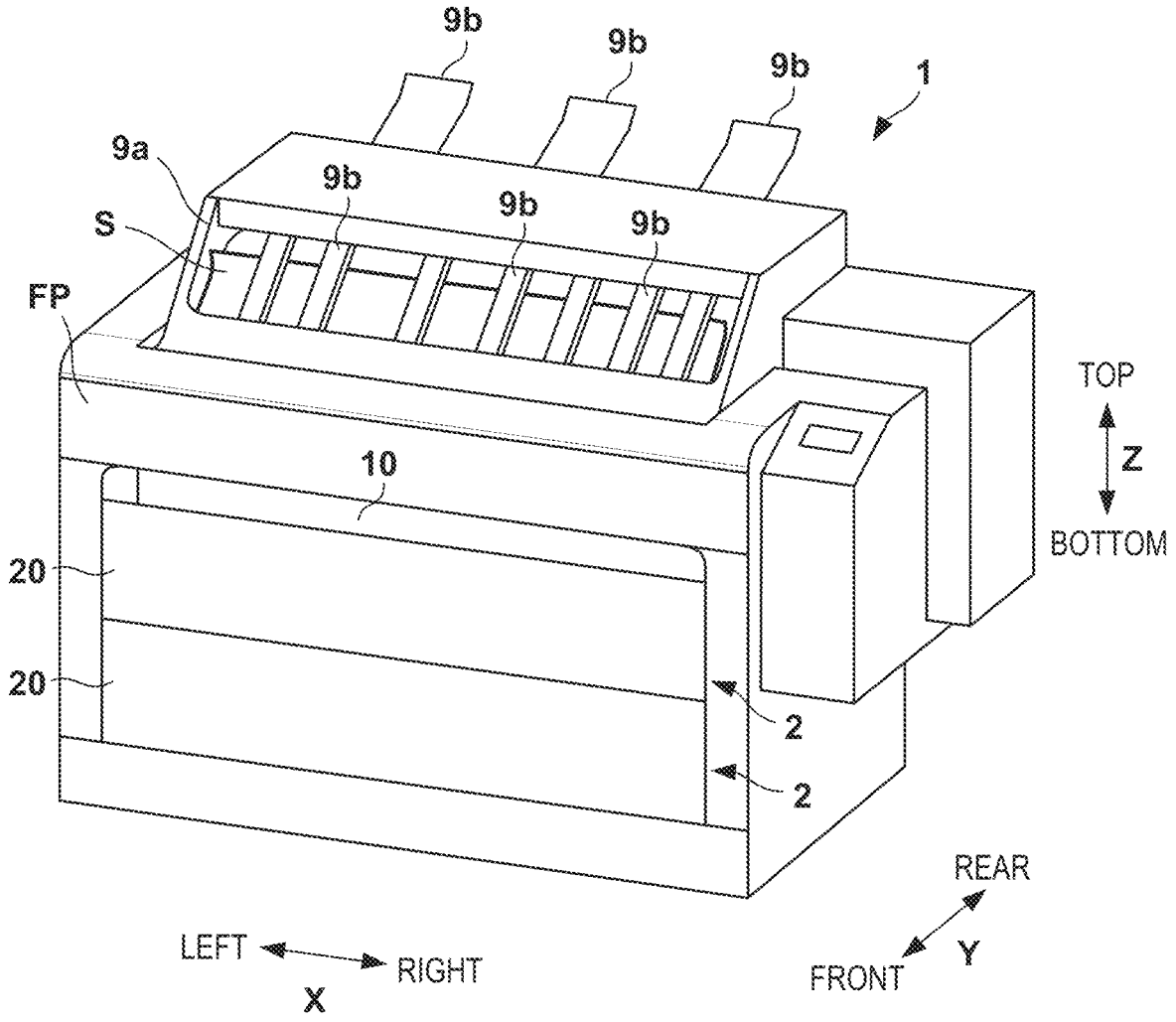
FIG. 1 is an external perspective view of a printing apparatus according to an embodiment of the present invention.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

Outline of Printing Apparatus

Figure 2:
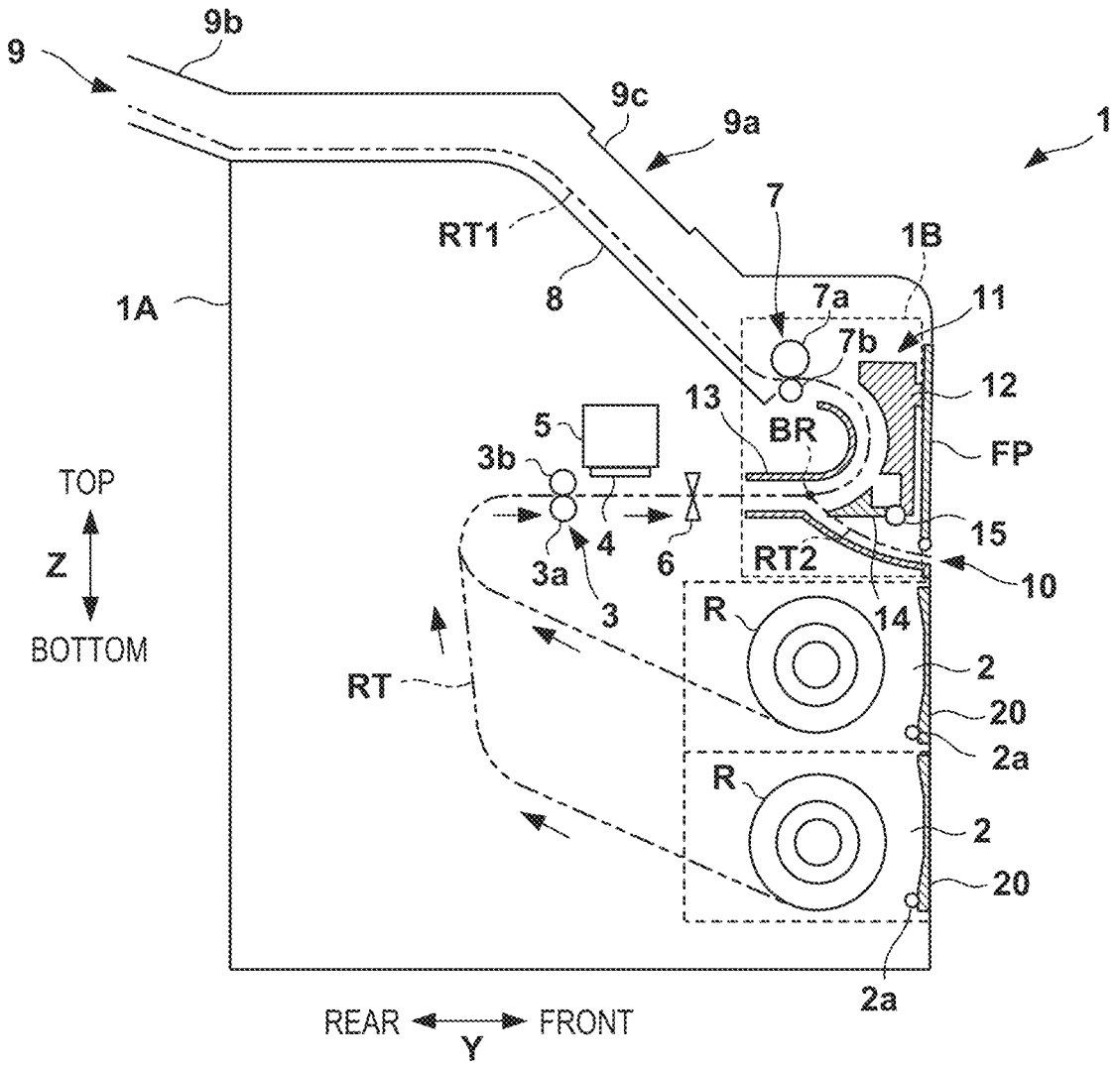
FIG. 2 is a schematic view showing the internal structure of the printing apparatus shown in FIG. 1.

FIG. 1 is an external perspective view of a printing apparatus 1 according to an embodiment of the present invention, and FIG. 2 is a schematic view showing the internal structure of the printing apparatus 1. An arrow X indicates the widthwise direction (left-and-right direction) of the printing apparatus 1, an arrow Y indicates the depth direction (front-and-rear direction) of the printing apparatus 1, and an arrow Z indicates the vertical direction. Note that "printing" includes not only forming significant information such as characters and graphics but also forming images, figures, patterns, and the like on print media in a broad sense, or processing print media, regardless of whether the information formed is significant or insignificant or whether the information formed is visualized so that a human can visually perceive it. In addition, although in this embodiment, sheet-like paper is assumed as a "print medium" serving as a print target, sheet-like cloth, a plastic film, and the like may be used as print media.

In the lower portion of the printing apparatus 1, a plurality of feeding units 2 are vertically arranged in a plurality of stages (two stages in this example). Each feeding unit 2 forms a storage portion that stores a roll sheet R as a print medium. The roll sheet R is stored, in the storage portion, in a posture in which its axial direction is directed to the X direction. Each feeding unit 2 includes support portions 21 (shown in FIG. 20 and the like) that support the roll sheet R so as to be rotatable around the X-direction axis, and also includes a feeding mechanism (not shown) that pulls out a sheet from the roll sheet R and feeds it to a conveyance path RT. In this embodiment, the widthwise direction of the sheet is the X direction.

The feeding unit 2 includes a door 20 that opens and closes the interior of the feeding unit 2. The door 20 is provided so as to be openable and closable with a hinge 2*a*, which is provided in the lower portion of the door 20 and has the X-direction axis, as the pivot center. The door 20 is provided in the front portion of the printing apparatus 1, so that the user can perform a replacement operation of the roll sheet R from the front of the printing apparatus 1. Note that in this embodiment, the roll sheet R is exemplified as the print medium, but the print medium may be a cut sheet.

The conveyance path RT is a sheet path defined by a guide structure which guides a sheet, and extends from the feeding unit 2 to an outlet port 9 or an outlet port 10 while curving in the midway. In the following description, an upstream side and a downstream side are the upstream side and the downstream side with respect to the sheet conveying direction, respectively.

The sheet pulled out from the roll sheet R is supplied through a conveying unit 3 to a position facing a printhead 4. The conveying unit 3 includes a conveying roller 3*a*, which is a driving roller, and a nip roller 3*b*, which is a driven roller pressed against the conveying roller 3*a*. While being nipped by the conveying roller 3*a* and the nip roller 3*b*, the sheet is conveyed on the conveyance path RT in the arrow direction by rotation of the rollers.

The printhead 4 is arranged on the downstream side of the conveying unit 3. The printhead 4 in this embodiment is an inkjet head which prints an image on a sheet by discharging ink. The printhead 4 uses a discharge energy generating device such as an electrothermal transducer (heater) or a piezoelectric device to discharge ink from the discharge port. The printing apparatus 1 according to this embodiment is a serial scanning inkjet printing apparatus, and the printhead 4 is mounted on a carriage 5. The carriage 5 is configured to be reciprocated in the X direction (the widthwise direction of the sheet) by a driving mechanism (not shown). In the vicinity of the printhead 4, the sheet is conveyed in the Y direction. By alternately repeating intermittent conveyance of the sheet by the conveying unit 3 and an operation including moving the carriage 5 and ink discharge by the printhead 4, an image is printed on the sheet.

Note that the serial scanning printing apparatus is exemplarily shown in this embodiment, but the present invention is also applicable to a full-line printing apparatus. In this case, a long printhead extending in the widthwise direction of a sheet is used as the printhead 4. Then, by discharging ink from the printhead while continuously conveying the sheet, an image is printed on the sheet. Further, although the inkjet printing apparatus is exemplarily shown in this embodiment, the present invention is also applicable to printing apparatuses of other printing types.

A cutting unit 6 is arranged on the downstream side of the printhead 4. The cutting unit 6 cuts the sheet, which has been pulled out from the roll sheet R and has an image printed thereon, in the widthwise direction of the sheet. With this, the roll sheet R is cut by the cutting unit 6 and becomes a cut sheet.

The conveyance path RT branches at a branch point BR on the downstream side of the cutting unit 6, thereby forming a plurality of exit paths including an exit path RT1 and an exit path RT2. The exit path RT1 is a sheet exit path extending from the branch point BR to the outlet port 9, and a path for discharging the sheet to the rear side in the Y direction. The exit path RT2 is a sheet exit path extending from the branch point BR to the outlet port 10, and a path for discharging the sheet to the front side in the Y direction. In this embodiment, the path length of the exit path RT1 is longer than that of the exit path RT2, and the exit path RT1 extends in the Y direction in the upper portion of the printing apparatus 1.

A switch member 14 is arranged at the branch point BR. The switch member 14 is provided so as to be pivotable with a common shaft 15 extending in the X direction as the pivot center. The switch member 14 switches, between the plurality of exit paths RT1 and RT2, the exit path used to discharge a sheet having undergone printing by the printhead 4. Switching of the exit paths is performed in accordance with, for example, user's selection instruction. The position of the switch member 14 shown in FIG. 2 is the position for selecting the exit path RT1.

The outlet port 9 is located in the rear portion of the printing apparatus 1, and open in the back face of the printing apparatus 1. A plurality of guides 9*b* that restrict a warp of the sheet is provided in the upper portion of the outlet port 9. The exit path RT1 passes above the common shaft 15, and a reversing portion 11, a discharge unit 7, and a stacking portion 8 are provided midway along the exit path RT1 from the upstream side toward the downstream side.

The reversing portion 11 is a structure for reversing the printed sheet. In this embodiment, by forming the shape of the path into a U shape (inverted C-shape in the side view shown in FIG. 2), the sheet is reversed. At the time of having passed through the printhead 4, the upper surface of the sheet is the image printed surface, but the image printed surface of the sheet becomes the lower surface after passing through the reversing portion 11. The reversing portion 11 includes a guide member 12, which forms a U-shaped outer path forming wall (guide surface), and a guide member 13, which forms the inner path forming wall (guide surface), and the path is formed between the guide members 12 and 13. The guide member 12 according to this embodiment is an openable and closable member which is provided so as to be pivotable with the common shaft 15 as the pivot center and opens and closes the exit path RT1. The front face side of the guide member 12 is covered by a front panel FP. The front panel FP is a panel that forms the front exterior of the printing apparatus 1, and provided so as to be pivotable around the X-direction pivot center axis provided in its lower end portion.

The discharge unit 7 includes a discharge roller 7*a*, which is a driving roller, and a nip roller 7*b* pressed against the discharge roller 7*a*. The stacking portion 8 is arranged on the downstream side of the discharge unit 7, and the discharge unit 7 conveys, to the stacking portion 8, the sheet with the image printed thereon by the printhead 4. The stacking portion 8 forms a tray which receives a plurality of sheets discharged from the discharge unit 7, and the stacking portion 8 is arranged inside the printing apparatus 1. The stacking portion 8 forms the exit path RT1 which is almost horizontal in the rear portion in the Y direction and slopes upward toward the rear portion in the front portion in the Y direction. Depending on the length of the sheet, the end portion of the sheet may come out of the outlet port 9. The stacking portion 8 forms a part of the exit path RT1.

A window portion 9*a* for exposing the stacking portion 8 is formed in the top portion of the printing apparatus 1, so that the user can visually recognize the stacking amount of sheets on the stacking portion 8 through the window portion 9*a*. A plurality of guide members 9*c* are disposed in the window portion 9*a* to prevent the sheet discharged onto the stacking portion 8 from being discharged from the window portion 9*a*.

The outlet port 10 is located in the front portion of the printing apparatus 1 and open to the front of the printing apparatus 1. The exit path RT2 is a path passing below the common shaft 15, and does not have a structure for reversing the sheet like the reversing portion 11. That is, the image printed surface of the sheet discharged from the outlet port 10 is the upper surface. Further, no sheet conveyance mechanism like the discharge unit 7 is provided midway along the exit path RT2. Accordingly, the sheet is conveyed by conveyance of the conveying unit 3, cut by the cutting unit 6, and discharged from the outlet port 10 due to its own weight or by a manual operation of the user.

As has been described above, in this embodiment, it is possible to select whether to discharge the sheet to the stacking portion 8 on the upper side or to the front of the printing apparatus 1. For example, if the number of discharged sheets is large, the stacking portion 8 may be selected, and if the sheet length is long, discharge from the outlet port 10 may be selected. In this manner, it is possible for the user to arbitrarily select the exit path.

Further, it is configured such that the exit path RT1 passes above the common shaft 15 serving as the pivot center of the guide member 12 and the switch member 14 and the exit path RT2 passes below the common shaft 15. Thus, an empty space between the two exit paths RT1 and RT2 can be utilized as the arrangement space of the common shaft 15, and downsizing of the printing apparatus 1 can be achieved.

In addition, since the two exit paths RT1 and RT2 can be switched by a pivot motion of the switch member 14, it is possible to switch the exit paths with a relatively simple arrangement. Further, the user can switch the two exit paths RT1 and RT2 without opening and closing the guide member 12, so that the exit paths can be switched relatively easily. Furthermore, when adjusting the two exit paths RT1 and RT2 for maintenance thereof or the like, they can be adjusted relatively easily.

Figure 3:
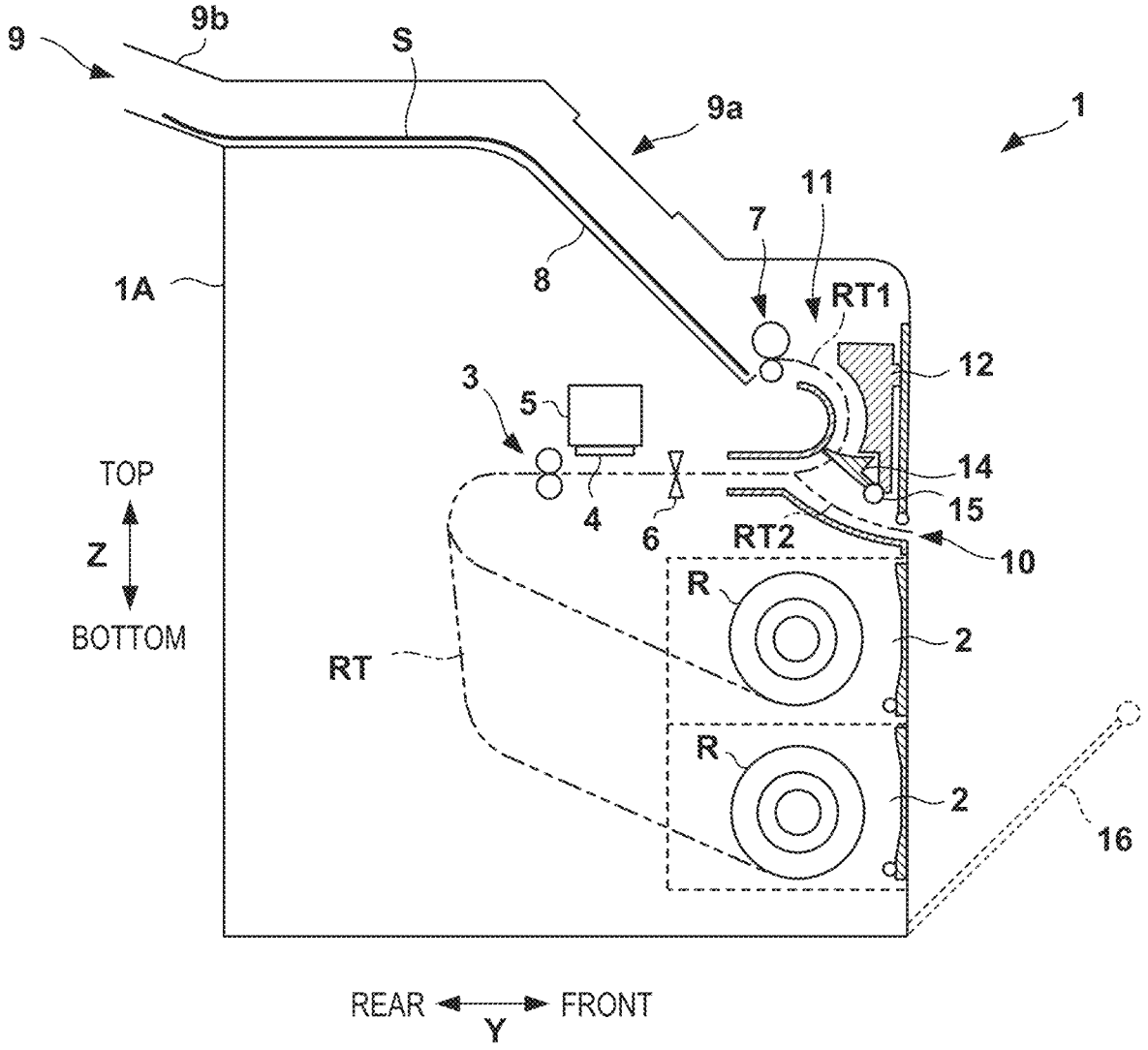
FIG. 3 is a view for explaining an operation of the printing apparatus shown in FIG. 1.
Figure 4:
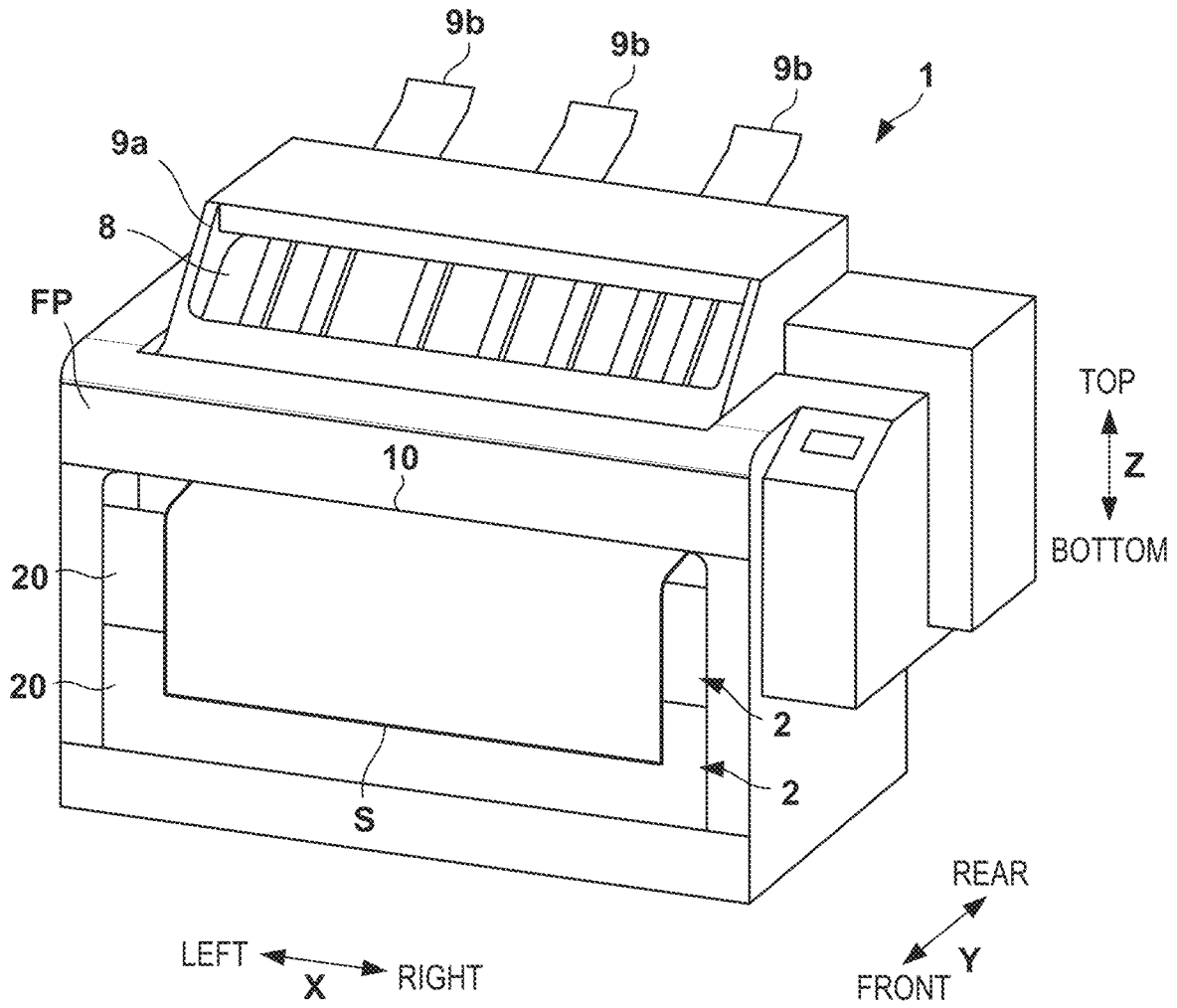
FIG. 4 is a view for explaining an example of the sheet discharge mode in the printing apparatus shown in FIG. 1.
Figure 5:
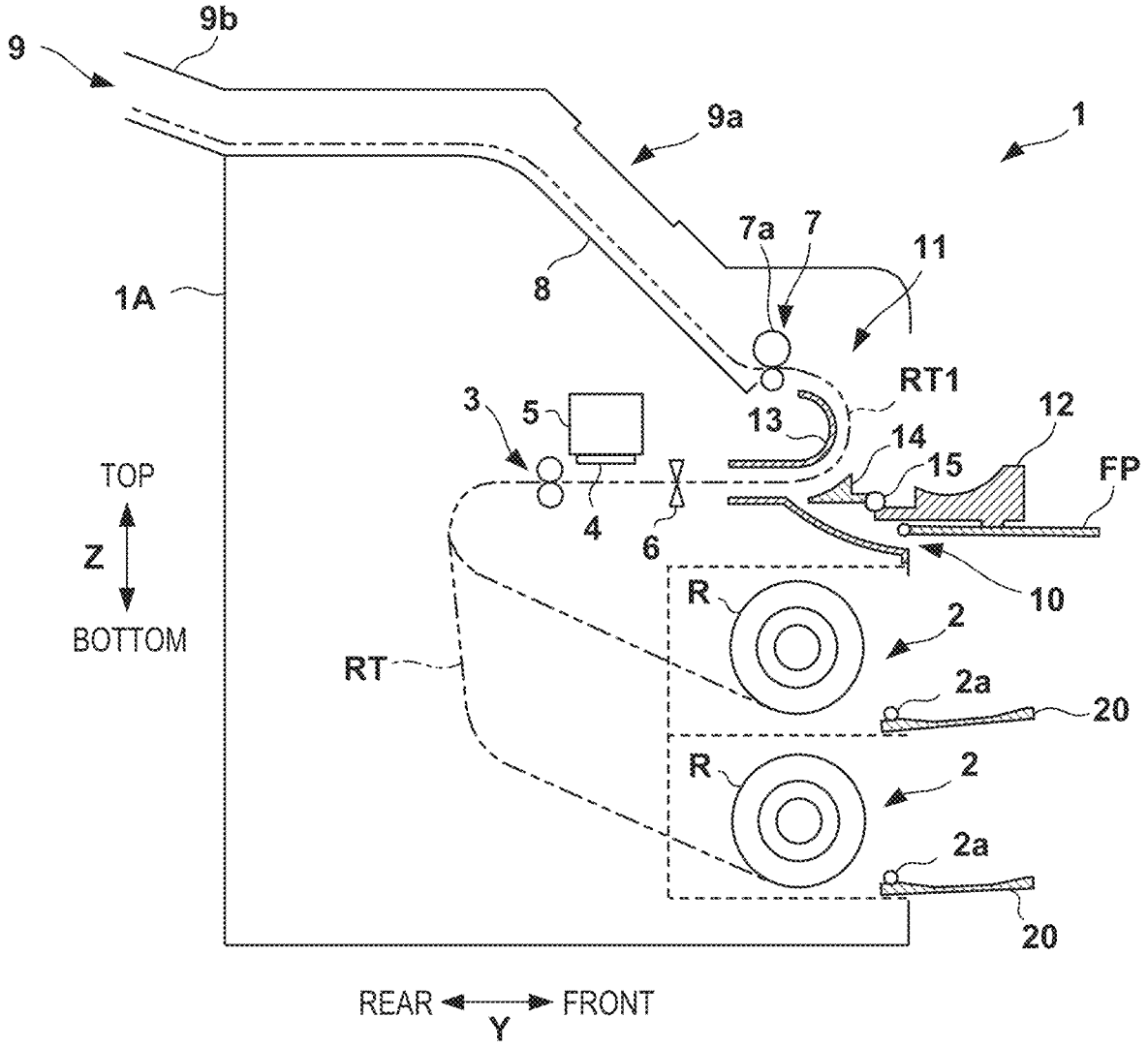
FIG. 5 is a view for explaining another operation of the printing apparatus shown in FIG. 1.

FIGS. 3 to 5 exemplarily show various modes of the printing apparatus 1. FIG. 3 shows a mode in which a printed sheet S has been discharged onto the stacking portion 8. The position of the switch member 14 in FIG. 3 is the position for selecting the exit path RT2. If the exit path RT2 is selected, the printed sheet S is discharged from the outlet port 10 to the front of the printing apparatus 1 in the mode shown in FIG. 4. At this time, the discharged sheet S is collected by a basket 16 as exemplarily shown in FIG. 3. The basket 16 may be a member different from the printing apparatus 1, or may be provided in the lower portion of the printing apparatus 1 so as to be retractable.

FIG. 5 shows a mode in which the doors 20 are open. The user can perform a replacement operation of the roll sheet R from the front of the printing apparatus 1. FIG. 5 also shows a mode in which the front panel FP and the guide member 12 are open. If a jam has occurred in the reversing portion 11, by opening the front panel FP and the guide member 12 in this manner, the exit path RT1 is opened and the jammed sheet can be taken out. Since the exit path RT1 is opened to the front of the printing apparatus 1, the user can perform a jam cancelation operation from the front of the printing apparatus 1.

Next, the printing apparatus 1 includes a main body 1A and a reversing unit 1B. The reversing unit 1B is an attachment/detachment unit detachable from the main body 1A. The reversing unit 1B according to this embodiment is a unit including the discharge unit 7, the reversing portion 11, the switch member 14, and the like. By removing the exterior of the printing apparatus 1, the reversing unit 1B is exposed and attachment/detachment thereof to/from the main body 1A can be performed. By separating the reversing unit 1B from the main body 1A, work such as a replacement operation of the worn discharge roller 7*a* or cleaning of the reversing portion 11, the switch member 14, or the like, can be efficiently performed.

Reversing Unit

Figure 6:
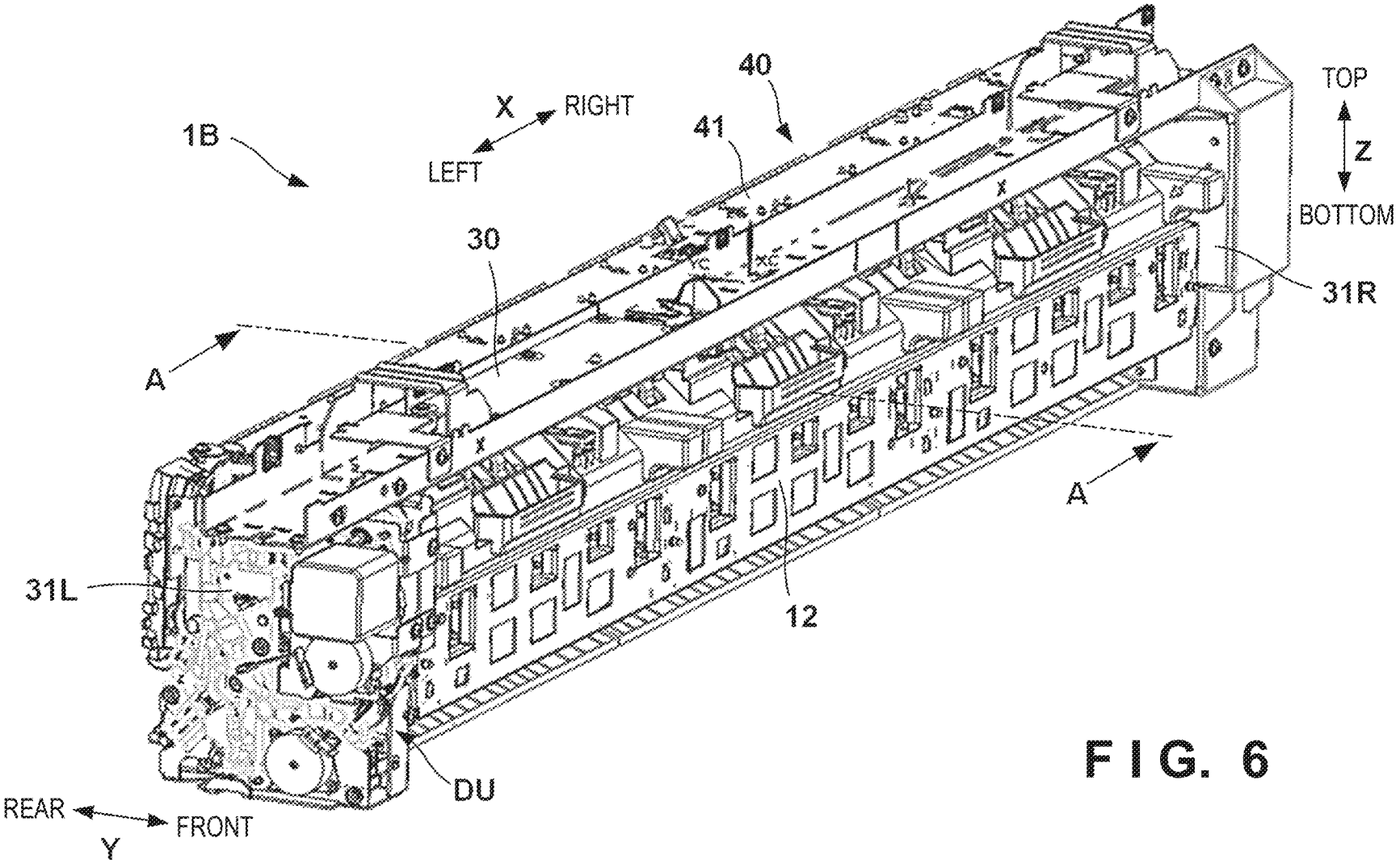
FIG. 6 is a perspective view of a reversing unit.
Figure 7:
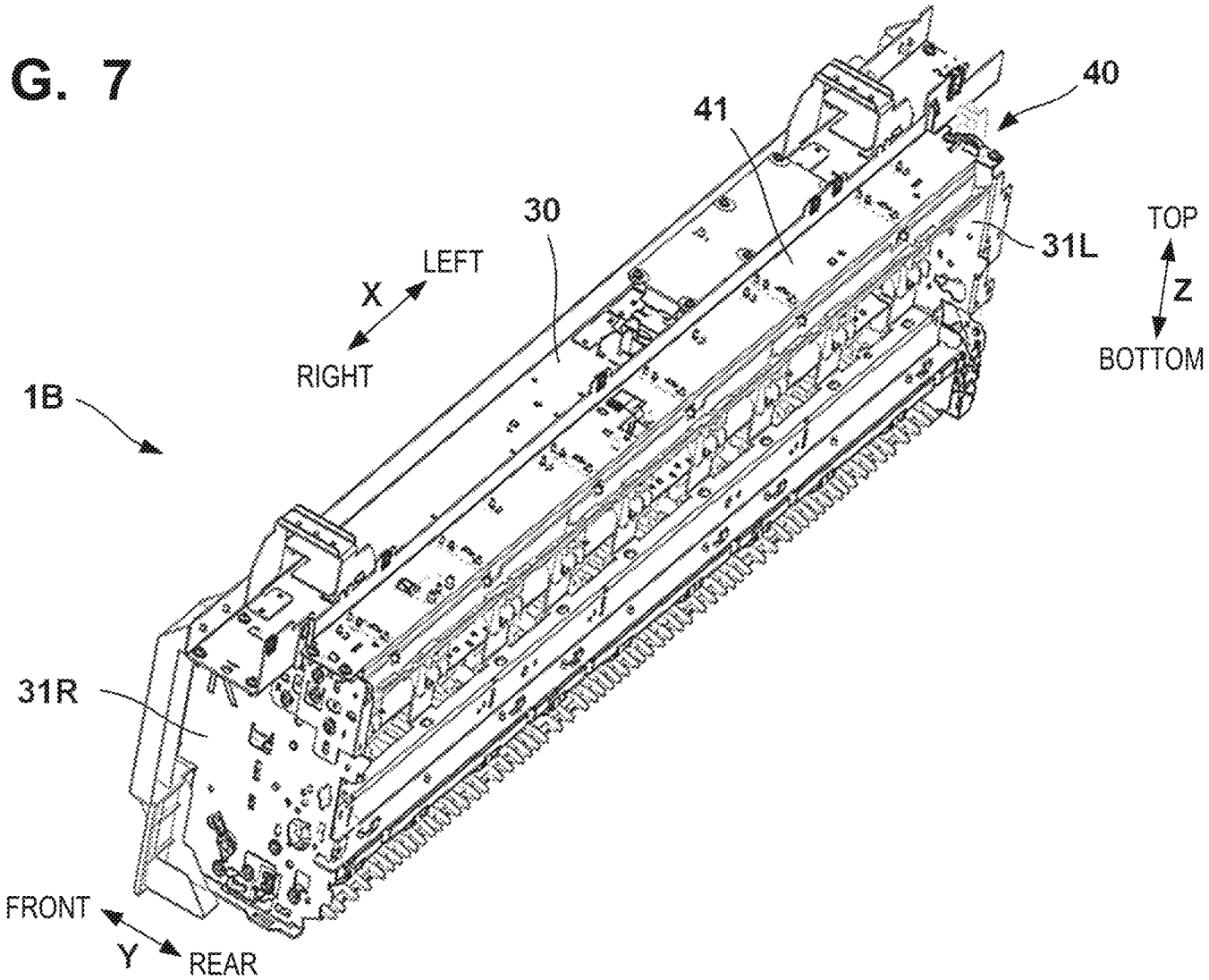
FIG. 7 is another perspective view of the reversing unit.

Each of FIGS. 6 and 7 is a perspective view of the reversing unit 1B. FIG. 6 is a perspective view of the reversing unit 1B when viewed from the front side, and FIG. 7 is a perspective view of the reversing unit 1B when viewed from the rear side. The reversing unit 1B includes a stay 30 which forms the skeleton thereof, and side plates 31L and 31R. The stay 30 is a plate-like member extending in the X direction. The side plate 31L is fixed to the left-side end portion of the stay 30, and the side plate 31R is fixed to the right-side end portion of the stay 30. A driving unit DU that drives the discharge unit 7, the switch member 14, and the like is supported by the side plate 31L.

Figure 8:
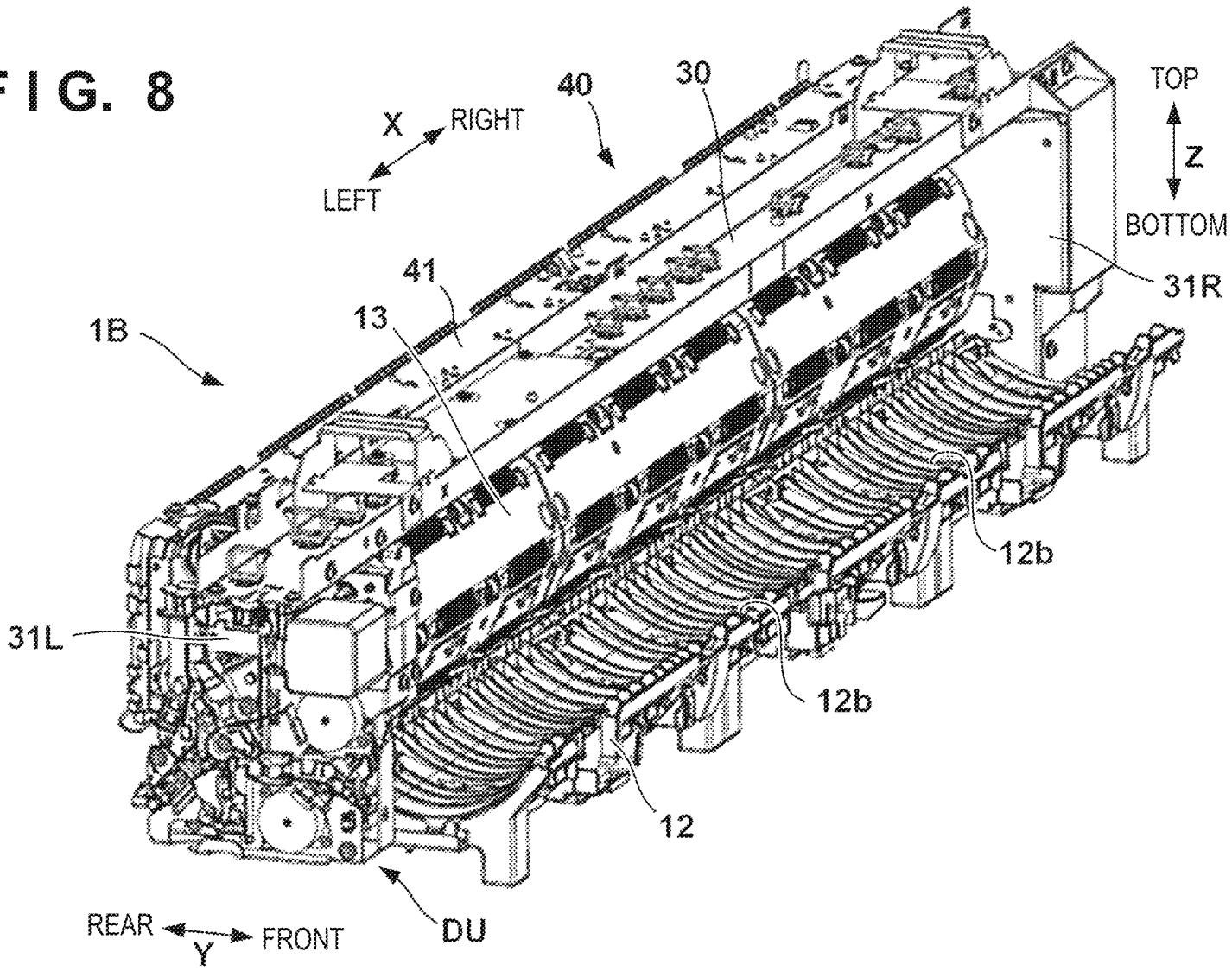
FIG. 8 is a view showing the open mode of a guide member in the reversing unit.
Figure 9:
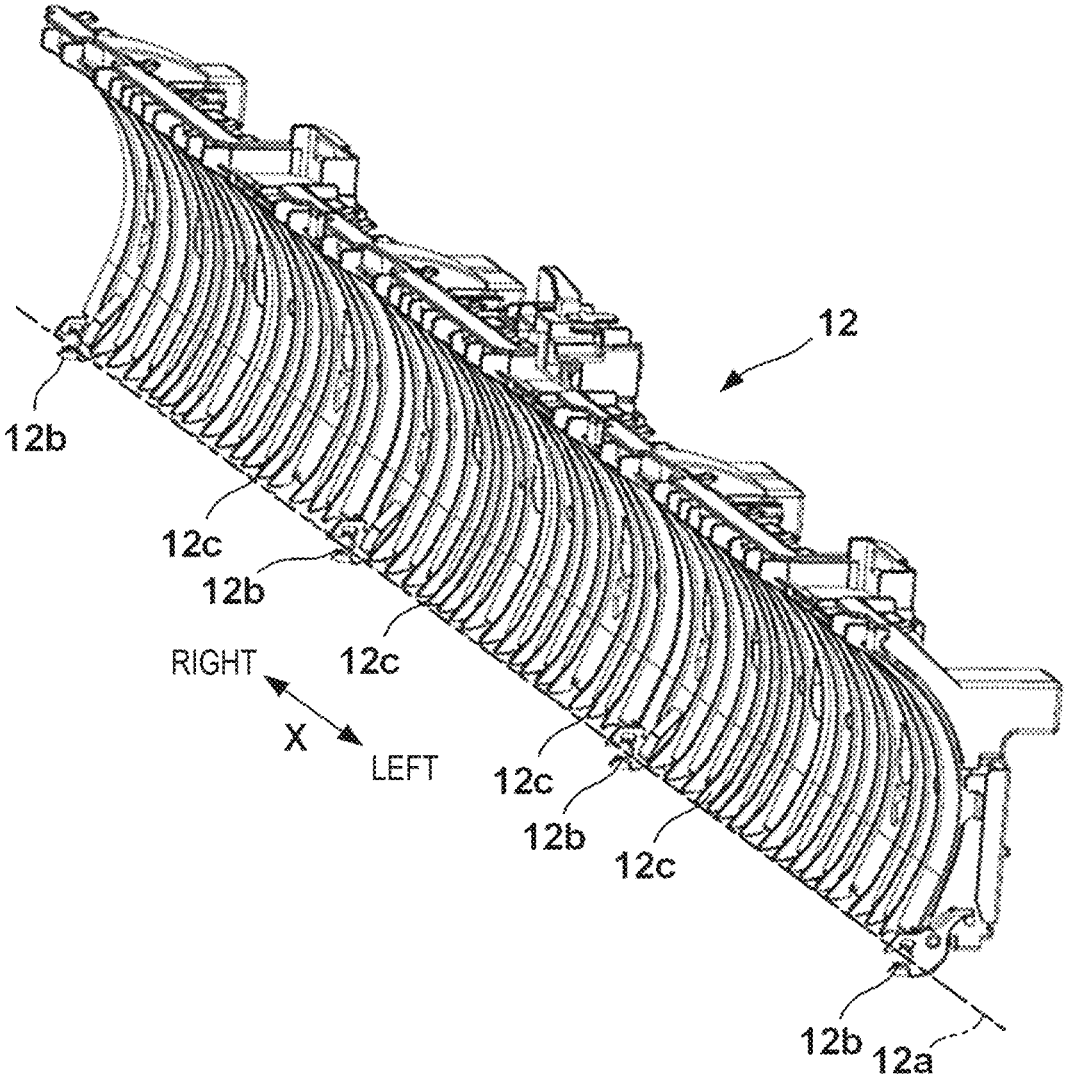
FIG. 9 is a perspective view of the guide member.

The guide member 12, the switch member 14, a discharge roller unit 40 which forms the discharge unit 7, and the like are supported between the side plates including the side plate 31L and the side plate 31R. Each of FIGS. 6 and 7 shows a case in which the guide member 12 is in a closed state, and FIG. 8 shows a case in which the guide member 12 is in an open state. FIG. 9 is a perspective view of the guide member 12.

In the lower end portion of the guide member 12, a plurality of engaging portions 12*b* spaced apart from each other in the X direction are formed on a pivot center line 12*a* defined by the common shaft 15. Each engaging portion 12*b* has a C shape, which engages with the common shaft 15, and separably engages with the common shaft 15. In a state in which the engaging portions 12*b* engage with the common shaft 15, the guide member 12 is pivotably supported by the common shaft 15. A plurality of ribs 12*c* spaced apart from each other in the X direction are formed in the inner side surface of the guide member 12. Each rib 12*c* has a C-shape sectional shape, and forms the outer path forming wall of the reversing portion 11.

Figure 10:
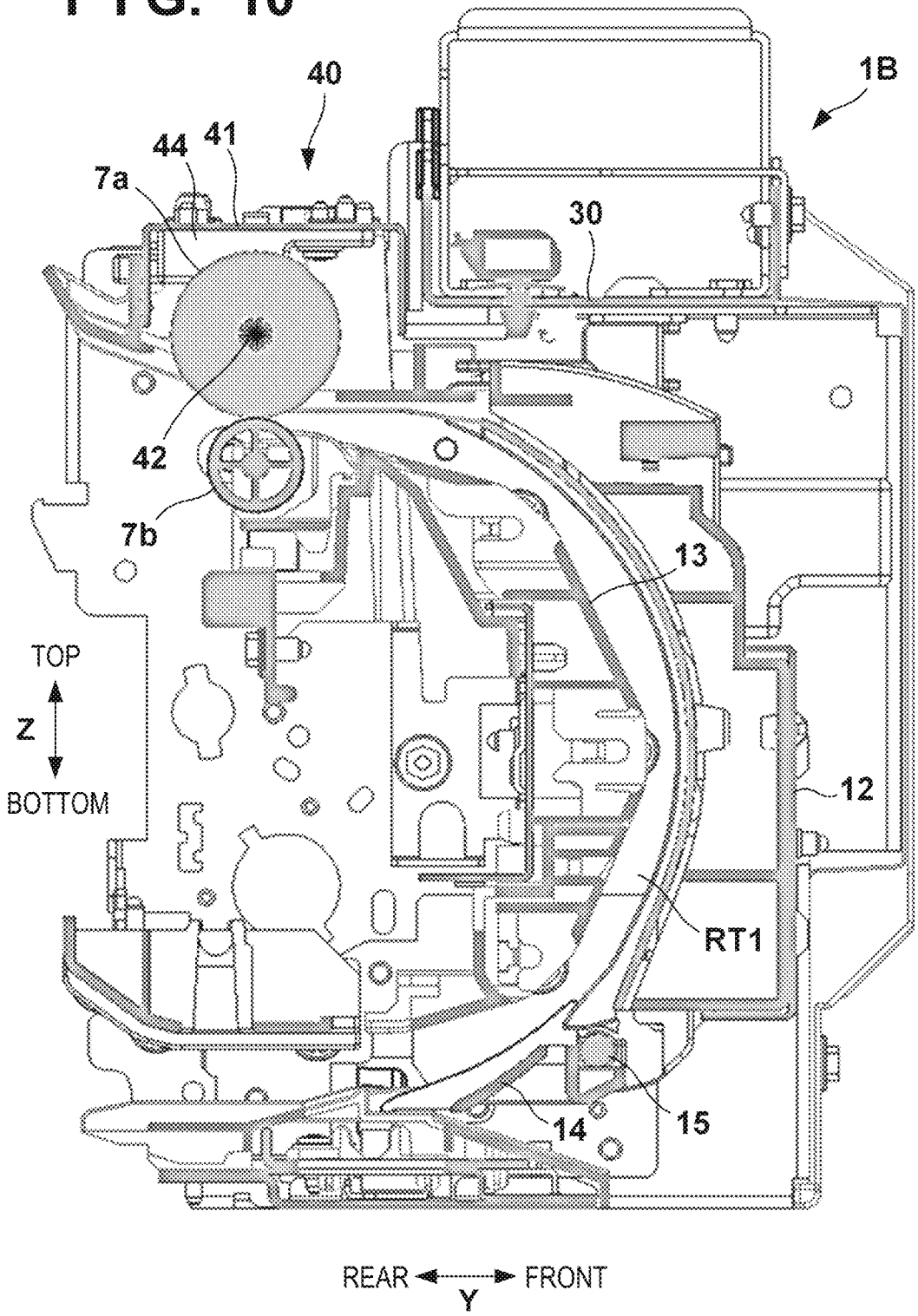
FIG. 10 is a sectional view taken along a line A-A in FIG. 6.
Figure 11A:
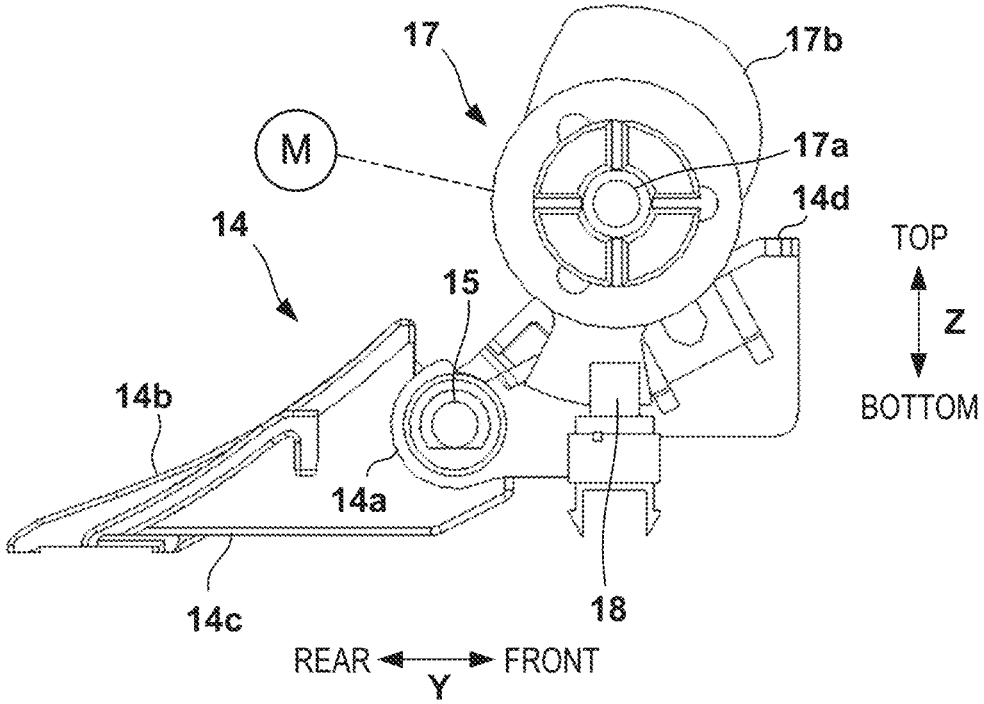
FIGS. 11A and 11B are views for explaining a switch member.
Figure 11B:
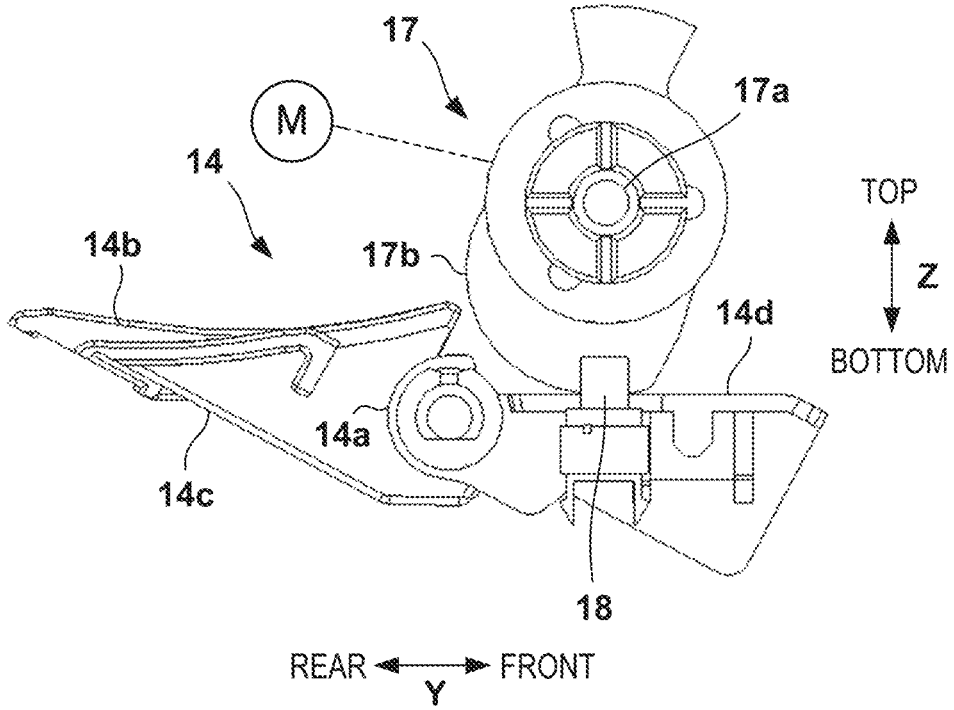

FIG. 10 is a sectional view of the reversing unit 1B taken along a line A-A in FIG. 6. The common shaft 15 is a single shaft member having a circular section, which is arranged in the lower portion of the reversing unit 1B extended between the side plate 31L and the side plate 31R. One end of the common shaft 15 is pivotably supported by the side plate 31L, and the other end thereof is pivotably supported by the side plate 31R. The switch member 14 is supported on the common shaft 15. Each of FIGS. 11A and 11B shows the switch member 14, a driving mechanism thereof, and the like. FIG. 11A shows the position (referred to as RT1 selecting position) of the switch member 14 for selecting the exit path RT1, and FIG. 11B shows the position (referred to as RT2 selecting position) of the switch member 14 for selecting the exit path RT2.

The switch member 14 includes a boss portion 14*a* including a hole through which the common shaft 15 is inserted. The switch member 14 is fixed to the common shaft 15 at the boss portion 14*a*. On the rear side of the boss portion 14*a*, the switch member 14 includes a sheet guide surface 14*b* for a case in which the exit path RT1 is selected, and a sheet guide surface 14*c* for a case in which the exit path RT2 is selected. The guide surface 14*b* also functions as a surface for preventing the sheet from entering the exit path RT2 when the exit path RT1 is selected. Similarly, the guide surface 14*c* also functions as a surface for preventing the sheet from entering the exit path RT1 when the exit path RT2 is selected.

The switch member 14 according to this embodiment pivots interlockingly with rotation of a cam member 17. The cam member 17 is provided so as to be pivotable around a shaft 17*a*, and rotated using a motor M included in the driving unit DU as a driving source. The cam member 17 includes a cam portion 17*b*. The cam portion 17*b* abuts against a lever portion 14*d* of the switch member 14, thereby causing the switch member 14 to pivot. The switch member 14 is located in the RT1 selecting position due to a bias by an elastic member (coil spring or the like) (not shown). When the cam member 17 is rotated by driving of the motor M, as shown in FIG. 11B, the cam portion 17*b* abuts against the lever portion 14*d* and causes the switch member 14 to pivot to the RT2 selecting position. The pivot amount of the cam member 17 is detected by a sensor 18, and the driving amount of the motor M is controlled. The sensor 18 is, for example, an optical sensor that detects the cam portion 17*b*.

Figure 12B:
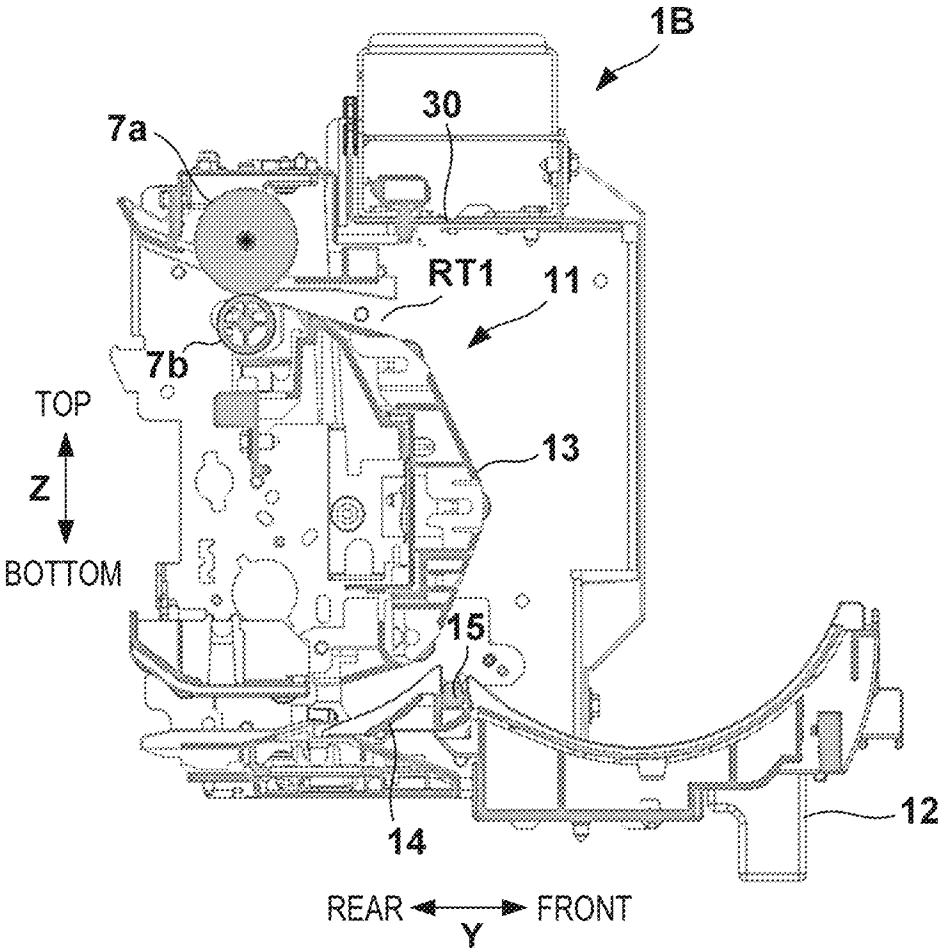
FIGS. 12A and 12B are views for explaining an operation of the reversing unit.
Figure 12A:
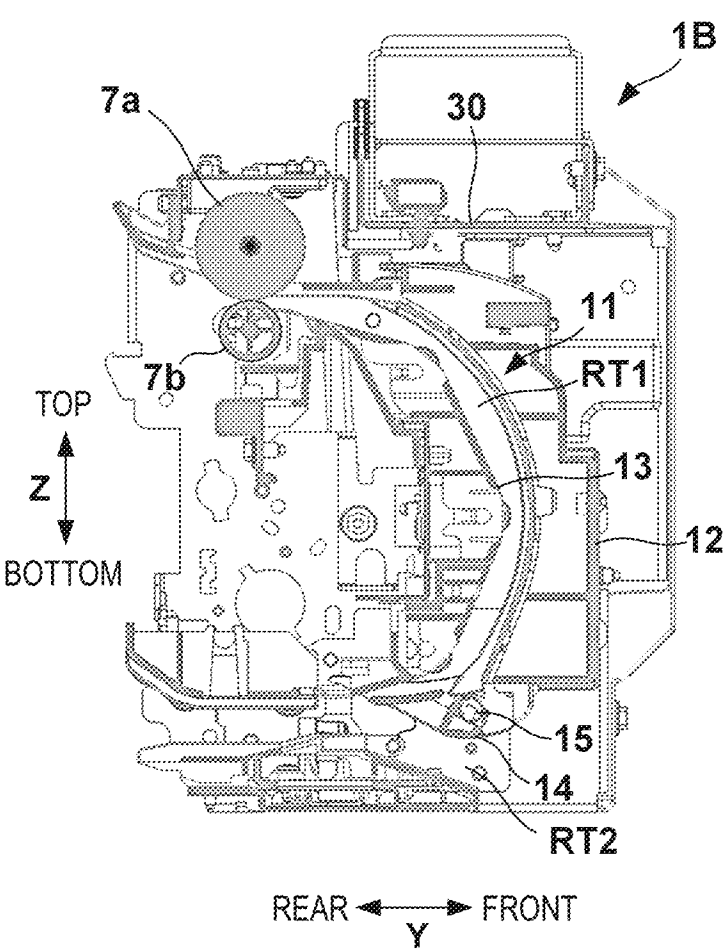

Each of FIGS. 12A and 12B shows an example of displacement of the switch member 14 and the guide member 12. FIG. 12A shows the example in which the switch member 14 is located in the RT2 selecting position. The guide surface 14*c* prevents the sheet from entering the exit path RT1. FIG. 12B shows the example in which the switch member 14 is located in the RT1 selecting position. The guide surface 14*b* prevents the sheet from entering the exit path RT1. FIG. 12A shows the example in which the guide member 12 is located in a closed position, and FIG. 12B shows the example in which the guide member 12 is located in an open position. The example in FIG. 12A shows a state in which the switch member 14 is located in the RT2 selecting position and the guide member 12 is located in the closed position. The example in FIG. 12B shows a state in which the switch member 14 is located in the RT1 selecting position and the guide member 12 is located in the open position. However, it is needless to say that other states such as a state in which the switch member 14 is located in the RT1 selecting position and the guide member 12 is located in the closed position are also established. Since the common shaft 15 is fixed with the switch member 14, the common shaft 15 is rotated by a pivot motion of the switch member 14. On the other hand, since the guide member 12 merely engages with the common shaft 15, even when the common shaft 15 rotates, the guide member 12 does not pivot and can maintain its position.

As has been described above, in this embodiment, by arranging the two pivot members (guide member 12 and switch member 14) coaxially, the number of shafts can be reduced as compared with a case in which each pivot member is arranged on the shaft specific thereto. Accordingly, downsizing of the reversing unit 1B can be achieved, and this leads to downsizing of the printing apparatus 1. Further, since the exit path RT2 passes below the common shaft 15, the common shaft 15 does not hinder discharge of the sheet S to the exit path RT2. Similarly, since the exit path RT1 passes above the common shaft 15, the common shaft 15 does not hinder discharge of the sheet S to the exit path RT1.

Note that the example in which the switch member 14 is fixed to the common shaft 15 has been exemplarily shown in this embodiment, but it may be configured such that the guide member 12 is fixed to the common shaft 15 and the switch member 14 engages with (for example, loosely fits to) the common shaft 15. Further, it is configured in this embodiment such that the single common shaft 15 is shared by the guide member 12 and the switch member 14, but it may be configured such that a shaft member for the guide member 12 and a shaft member for the switch member 14 are separate members arranged coaxially. Also in this configuration, as compared with the configuration in which the guide member 12 and the switch member 14 are arranged on different axes, downsizing of the printing apparatus 1 can be achieved.

Figure 13:
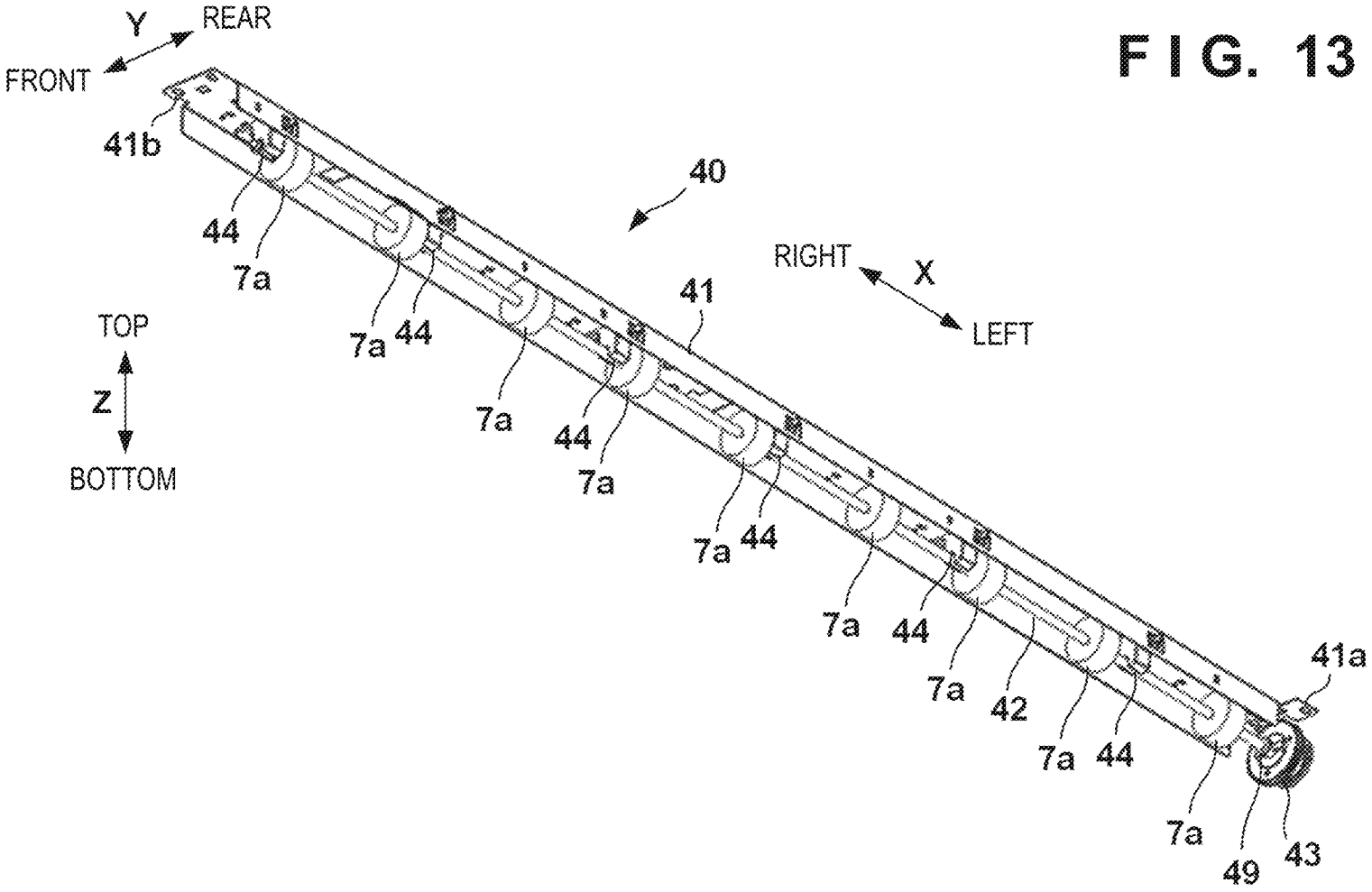
FIG. 13 is a perspective view of a discharge roller unit.
Figure 14:
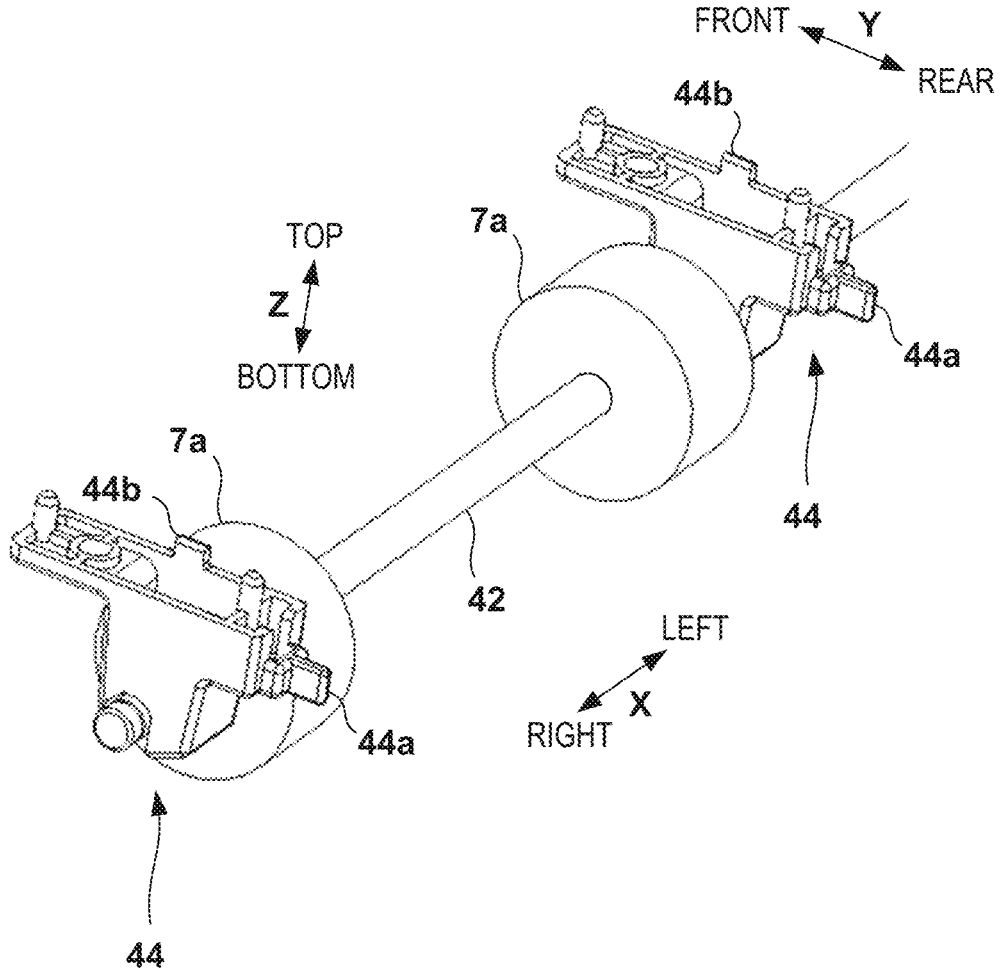
FIG. 14 is a partially enlarged view of the discharge roller unit.

Position Adjustment Mechanism of Discharge Roller Unit and Skeleton Structure The reversing unit 1B includes the discharge roller unit 40 that supports the discharge roller 7*a* of the discharge unit 7. Refer to FIGS. 13 and 14 in addition to FIGS. 6 and 7. FIG. 13 is a perspective view of the discharge roller unit 40, and FIG. 14 is a partially enlarged view thereof. The discharge roller unit 40 includes a stay 41 extending in the X direction. The stay 41 is juxtaposed with the stay 30 in the Y direction, and supported between the side plate 31L and the side plate 31R. A plurality of bearings 44 spaced apart from each other in the X direction are supported by the stay 41. The bearings 44 rotatably support a roller shaft 42 extending in the X direction. One end portion of the roller shaft 42 is supported by a bearing 49. The bearing 49 is supported by the side plate 31L. A plurality of the discharge rollers 7*a* spaced apart from each other in the X direction are fixed to the roller shaft 42. As shown in FIG. 14, the bearing 44 includes position reference pieces 44*a* and 44*b*. The position reference pieces 44*a* and 44*b* are used to adjust the inclination of the discharge roller unit 40 in the Y and Z directions.

Figure 15:
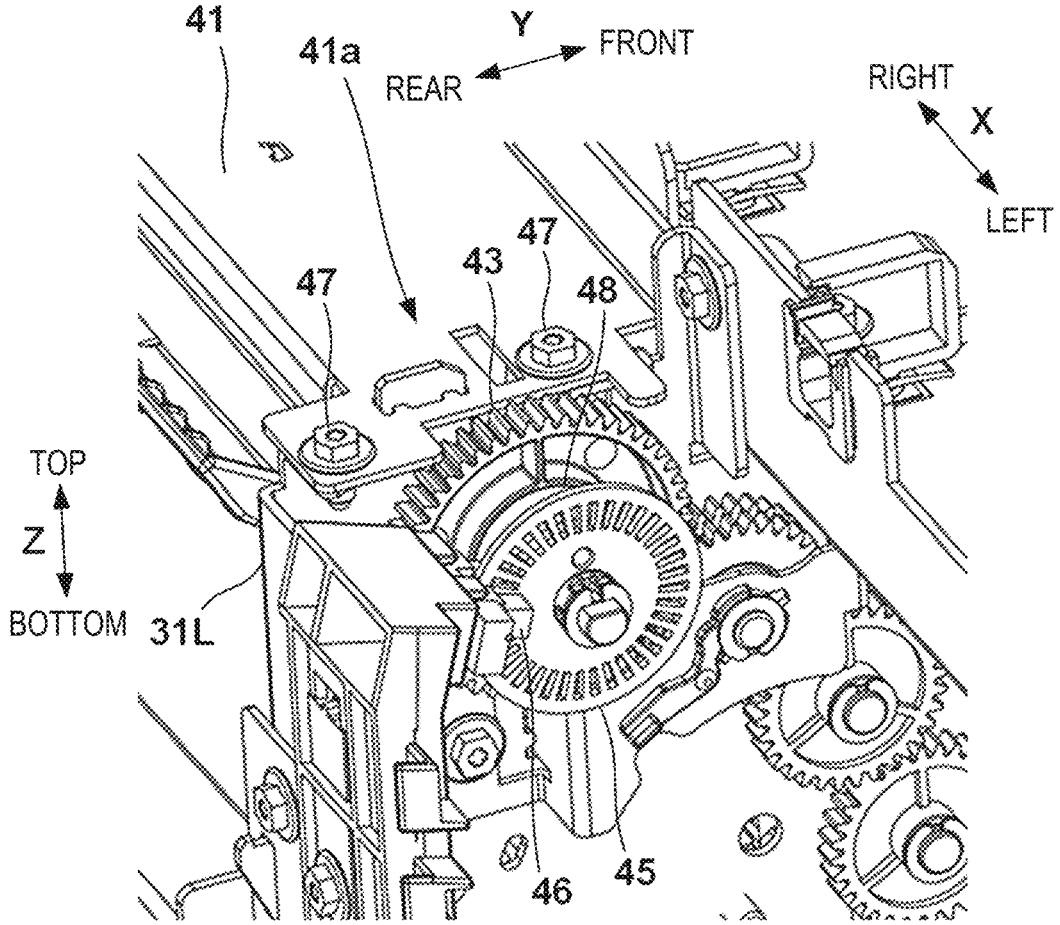
FIG. 15 is a perspective view of an end portion of the discharge roller unit.

A gear 43 is provided in the left end portion of the roller shaft 42. A driving force from a driving source (motor) provided in the driving unit DU is input to the gear 43 to rotate the roller shaft 42 (that is, the discharge rollers 7*a*). FIG. 15 is a perspective view showing the structure in the vicinity of the gear 43.

In this embodiment, the gear 43 is attached to the roller shaft 42 through a torque limiter 48. In a printing operation, the rotation speed of the discharge roller 7*a* is controlled such that the conveyance speed of the sheet S is constantly faster than the conveyance speed of the conveying roller 3*a*. In a situation in which the sheet S is conveyed while being nipped by both the conveying unit 3 and the discharge unit 7, if the sheet conveyance speed of the discharge unit 7 is slower than the conveyance speed of the conveying unit 3, a slack of the sheet S is generated. This causes a jam. A slack of the sheet S can be prevented by controlling such that the sheet conveyance speed of the discharge unit 7 is faster than the conveyance speed of the conveying unit 3, but the sheet S may be damaged if the tension is strong. In this embodiment, the tension of the sheet S can be limited by limiting the torque of the roller shaft 42 using the torque limiter 48.

A code wheel 45 is also fixed to the roller shaft 42, and the reversing unit 1B is provided with an optical sensor (photointerrupter) 46 which detects the slit of the code wheel 45. It is possible to detect the rotation amount of the discharge roller 7*a* using the code wheel 45 and the optical sensor 46.

Figure 16:
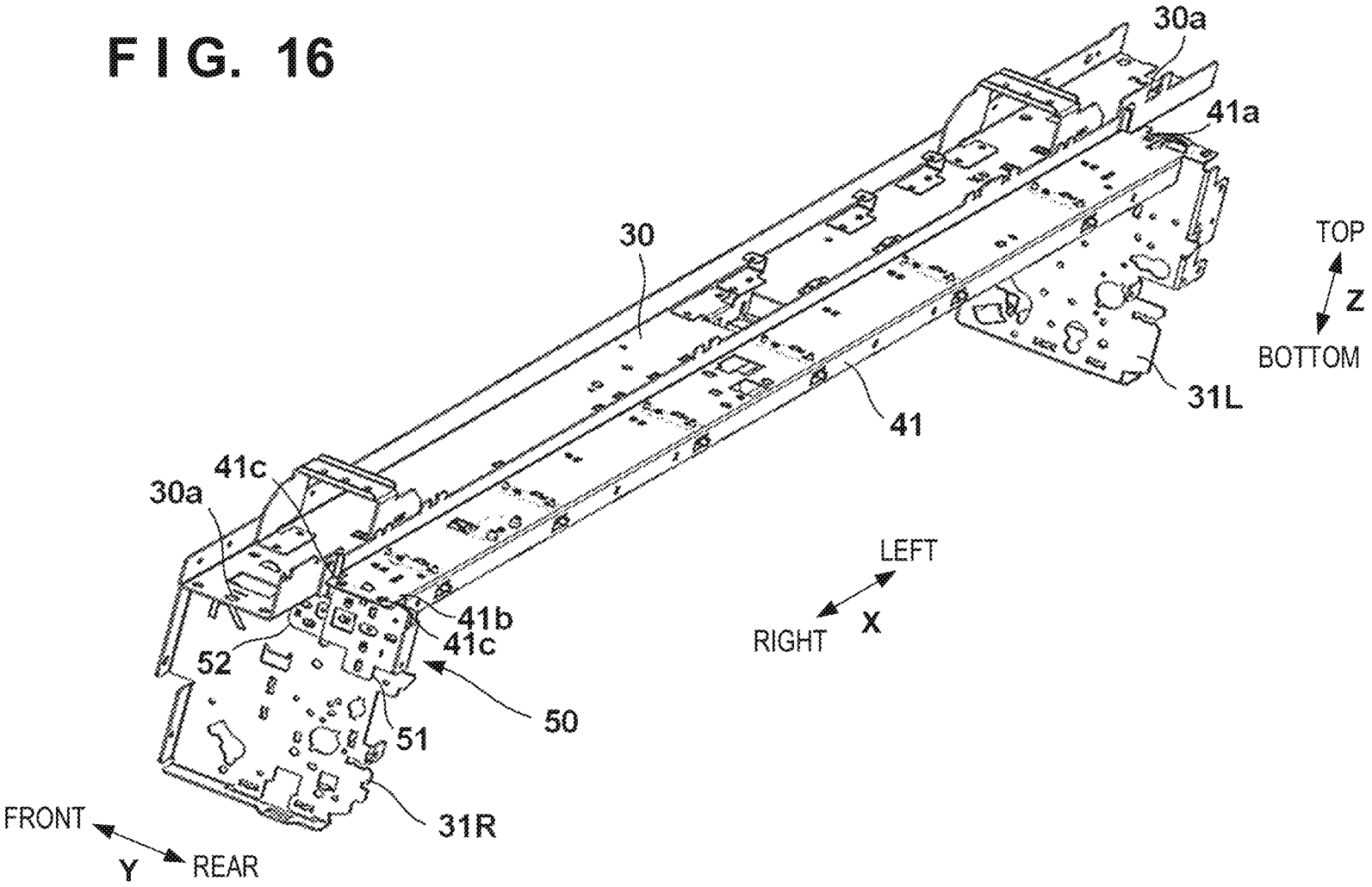
FIG. 16 is a perspective view of the skeleton of the reversing unit.

FIG. 16 is a perspective view showing the stay 30 and the side plates 31L and 31R, which form the skeleton of the reversing unit 1B, together with the stay 41. The stay 41 includes a left end portion 41*a* and a right end portion 41*b*. The left end portion 41*a* is fixed to the side plate 31L by fasteners 47 (see FIG. 15), and the right end portion 41*b* is fixed to the side plate 31R through a position adjustment mechanism 50.

In this embodiment, discharge of the sheet S onto the stacking portion 8 is performed by the discharge unit 7. Therefore, arranging the discharge unit 7 (particularly, the discharge rollers 7*a*) at a position close to the stacking portion 8 leads to an improvement in discharge accuracy. An improvement in discharge accuracy is also influenced by the positional accuracy of the discharge rollers 7*a* with respect to the main body 1A. In this embodiment, since the discharge roller unit 40 is arranged adjacent to the stay 30 serving as a connection part between the reversing unit 1B and the main body 1A, each discharge roller 7*a* can be arranged at a position close to the stacking portion 8 and the positional accuracy of the discharge rollers 7*a* with respect to the main body 1A can also be improved.

If the discharge roller unit 40 is inclined in the X direction, this causes a skew of the sheet S. In this embodiment, since the gear 43 exists in one end portion of the roller shaft 42 on the left side, the position of the other end portion of the roller shaft 42 on the right side, that is, the position of the right end portion 41*b* of the stay 41 is adjusted by the position adjustment mechanism 50. With this, the X-direction parallelism of the discharge roller unit 40 (that is, the roller shaft 42) with respect to the stay 30 and the side plates 31L and 31R is adjusted. That is, the position adjustment mechanism 50 is a roller position adjustment mechanism.

Figure 17A:
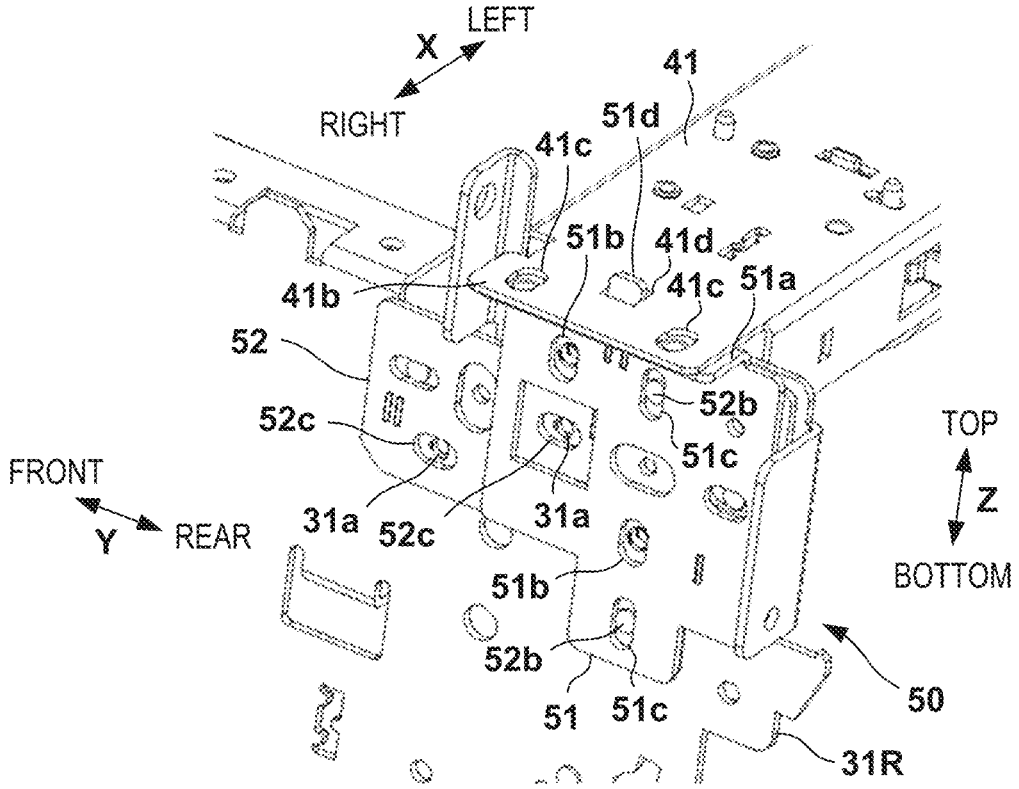
FIGS. 17A and 17B are views for explaining a position adjustment mechanism.
Figure 17B:
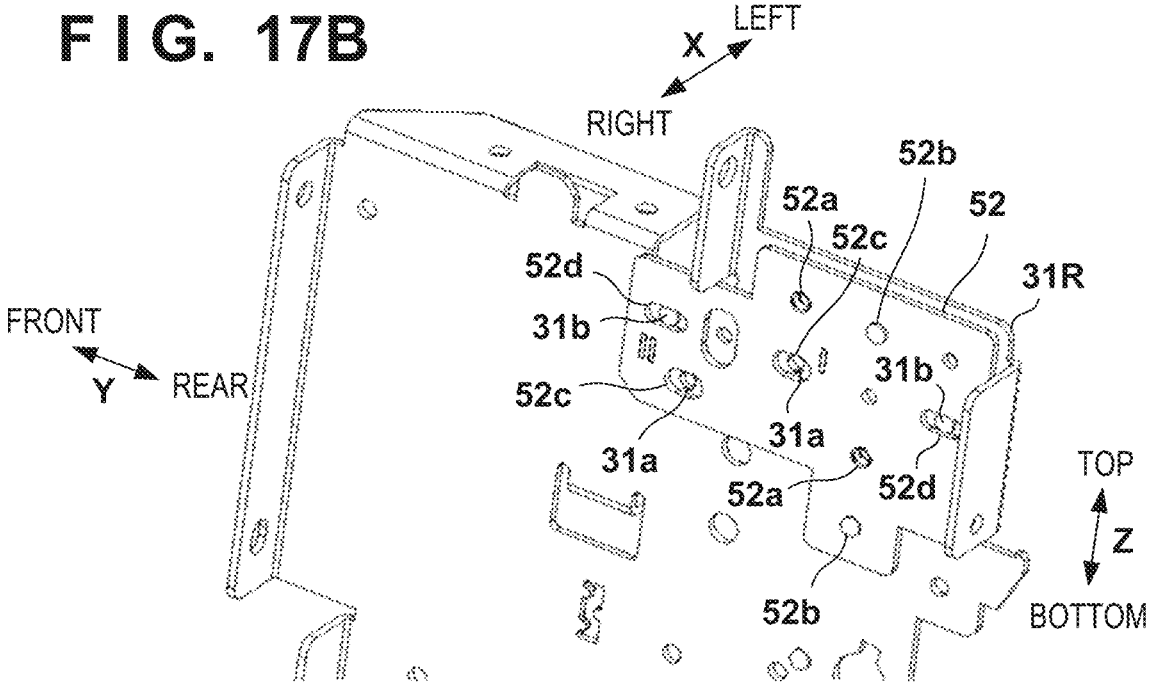

FIG. 17A is a perspective view of the position adjustment mechanism 50. The position adjustment mechanism 50 includes an adjustment member 51 which adjusts the Z-direction position of the end portion 41*b*, and an adjustment member 52 which adjusts the Y-direction position thereof. The adjustment members 51 and 52 are overlapped in the X direction and fixed to the side plate 31R. FIG. 17B shows a mode in which the adjustment member 51 has been removed. By using the adjustment members 51 and 52, the position of the right end portion of the roller shaft 42 can be adjusted in two directions intersecting the axial direction of the roller shaft 42, so that the X-direction parallelism of the roller shaft 42 can be more accurately adjusted.

The adjustment member 51 includes an attachment portion 51*a* on which the end portion 41*b* of the stay 40 is overlapped in the Z direction. The end portion 41*b* is formed with two long holes 41*c* extending in the X direction and an opening portion 41*d* into which a protruding piece 51*d* of the attachment portion 51*a* is inserted. When the protruding piece 51*d* is inserted into the opening portion 41*d*, the adjustment member 51 and the stay 40 are positioned in the Y direction. The attachment portion 51*a* is formed with screw holes which respectively overlap the long holes 41*c*. When a screw (not shown) is fastened to each screw hole through the long hole 41*c*, the stay 40 is fixed to the adjustment member 51.

The adjustment member 51 includes two long holes 51*b* extending in the Z direction and two long holes 51*c* extending in the Z direction. Cylindrical projections 52*b* projecting from the adjustment member 52 in the X direction are respectively inserted into the long holes 51*c*. The Y-direction position of the adjustment member 51 with respect to the adjustment member 52 is constrained by the long holes 51*c* and the projections 52*b*, but the Z-direction position of the adjustment member 51 is adjustable. The adjustment member 52 includes screw holes 52*a* at positions each overlapping the long hole 51*b*. When a screw (not shown) is fastened to each screw hole 52*a* through the long hole 51*c*, the adjustment member 51 is fixed to the adjustment member 52.

The adjustment member 52 includes two long holes 52*c* extending in the Y direction and two long holes 52*d* extending in the Y direction. Cylindrical projections 31*b* projecting from the side plate 31R in the X direction are respectively inserted into the long holes 52*d*. The Z-direction position of the adjustment member 52 with respect to the side plate 31R is constrained by the long holes 52*d* and the projections 31*b*, but the Y-direction position of the adjustment member 52 is adjustable. The side plate 31R includes screw holes 31*a* at positions each overlapping the long hole 52*c*. When a screw (not shown) is fastened to each screw hole 31*a* through the long hole 52*c*, the adjustment member 52 is fixed to the side plate 31R.

During an attachment operation of the discharge roller unit 40 to the side plates 31L and 31R, first, the end portion 41*a* of the stay 40 is fixed to the side plate 31L and the end portion 41*b* is temporarily fixed to the adjustment member 51. Then, after adjusting the X-direction parallelism of the roller shaft 42 by the position adjustment mechanism 50, the end portion 41*b* is fixed to the adjustment member 51 and the adjustment members 51 and 52 are fixed to the side plate 31R.

When adjusting the parallelism, a reference portion 30*a* formed in each X-direction end portion of the stay 30 shown in FIG. 16 is used as a reference. The reference portion 30*a* is a portion that serves as a reference for the positional relationship between the reversing unit 1B and the main body 1A upon attaching the reversing unit 1B to the main body 1A. In this embodiment, the reference portion 30*a* is a hole extending through the stay 30 in the Z direction. A virtual line connecting the two reference portions 30*a* serves as a reference for adjusting the parallelism of the roller shaft 42. During adjustment in the Y direction, the position of the adjustment member 52 is adjusted such that the distances from the virtual line to the position reference pieces 44*a* of the respective bearings 44 become equal to each other. During adjustment in the Z direction, the position of the adjustment member is adjusted such that the distances from the virtual line to the position reference pieces 44*b* of respective bearings 44 become equal to each other. When adjusting the positions of the adjustment members 51 and 52, the workability is improved by using an eccentric cam (not shown) or the like. When measuring the distance, for example, a jig including a linear member along the virtual line may be attached to the reference portions 30*a*, and the distances from the jib to the position reference pieces 44*a* and 44*b* may be actually measured.

With the adjustment described above, the positioning of the discharge roller unit 40 in the reversing unit 1B is completed. Then, the reversing unit 1B is attached to the main body 1A at an appropriate position. Thus, the high parallelism between the axis of the conveying rollers 3*a* of the main body 1A and the axis of the discharge rollers 7*a* of the reversing unit 1B can be ensured.

Position Adjustment Mechanism of Reversing Unit

Figure 18:
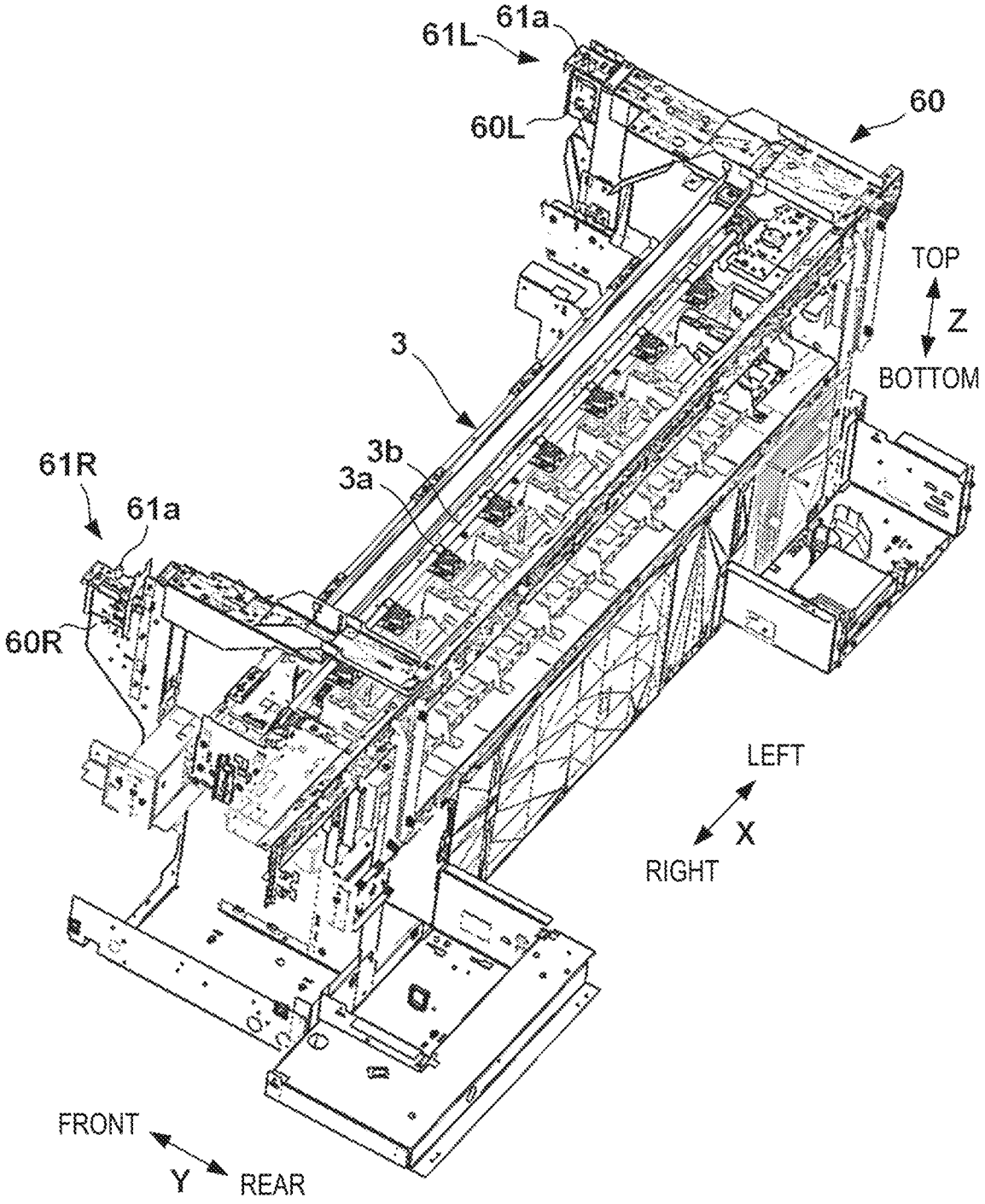
FIG. 18 is a partial perspective view of a main body.

FIG. 18 is a perspective view showing a part of the main body 1A to which the reversing unit 1B is attached. The main body 1A is provided with a pair of support portions 60L and 60R spaced apart from each other in the X direction, and the reversing unit 1B is supported so as to bridge over the pair of support portions 60L and 60R.

The support portions 60L and 60R are formed with reference portions 61*a* which engage with the reference portions 30*a* of the stay 30 through position adjustment mechanisms 61L and 61R, respectively. In this embodiment, the reference portion 61*a* is a pin to be inserted into the reference portion (hole) 30*a*, and projecting from each of the support portions 60L and 60R in the Z direction. The position adjustment mechanisms 61L and 61R are mechanisms for adjusting the attachment position of the reversing unit 1B with respect to the main body 1A. The position adjustment mechanism 61L is a mechanism for adjusting the Y-direction position and the Z-direction position of the reference portion 61*a* on the support portion 60L side. The position adjustment mechanism 61R is a mechanism for adjusting the Y-direction position and the Z-direction position of the reference portion 61*a* on the support portion 60R side. Before the attachment of the reversing unit 1B, the parallelism between a virtual line connecting the two reference portions 61*a* and a roller shaft 3*c* supporting the conveying rollers 3*a* is adjusted. With this, when the reversing unit 1B is attached to the main body 1A, the parallelism between the roller shaft 3*c* and the roller shaft 42 is ensured without additional adjustment work. That is, the position adjustment mechanisms 61L and 61R serve as a unit position adjustment mechanism.

Figure 19A:
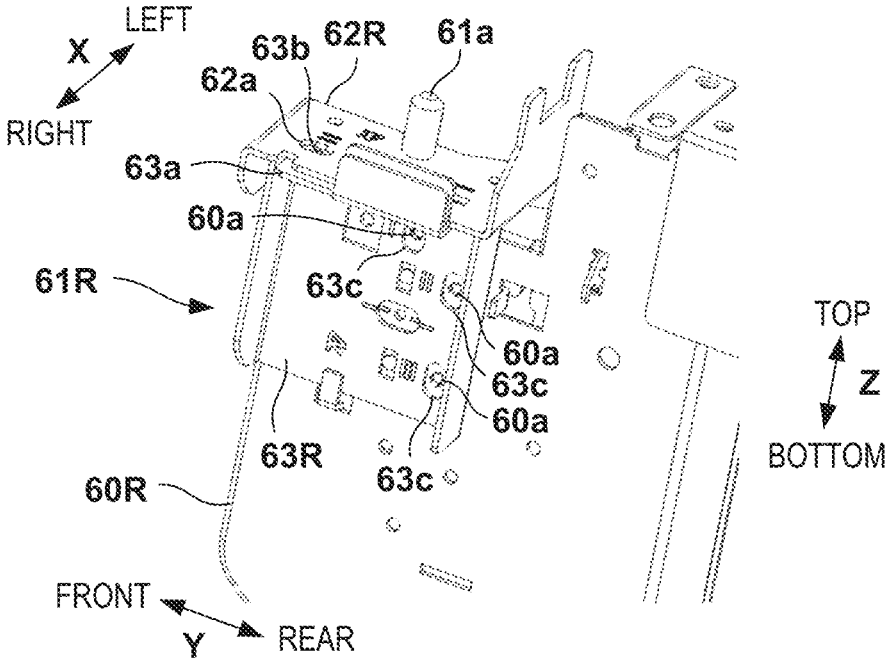
FIGS. 19A and 19B are views each for explaining another position adjustment mechanism.

FIG. 19A is a perspective view of the position adjustment mechanism 61R. The position adjustment mechanism 61R includes an adjustment member 62R on which the reference portion 61*a* stands, and an adjustment member 63R. The adjustment member 62R is a member for adjusting the Y-direction position of the reference portion 61*a*, and the adjustment member 63R is a member for adjusting the Z-direction position of the reference portion 61*a*. By using the adjustment members 62R and 63R, the position of the reference portion 61*a* can be adjusted in two directions intersecting the axial direction of the roller shaft 3*c*.

The adjustment member 63R includes an attachment portion 63*a* on which the adjustment member 62R is overlapped in the Z direction. The adjustment member 62R is formed with a long hole 62*a* extending in the Y direction. The attachment portion 63*a* is formed with a screw hole 63*b* at a position overlapping the long hole 62*a*. When a screw (not shown) is fastened to the screw hole 63*b* through the long hole 62*a*, the adjustment member 62R is fixed to the adjustment member 63R. The adjustment member 63R includes a plurality of long holes 63*c* extending in the Z direction. The support portion 60R includes screw holes 60*a* formed at positions overlapping the long holes 63*c*. When a screw (not shown) is fastened to each screw hole 60*a* through the long hole 63*c*, the adjustment member 63R is fixed to the support portion 60R.

Figure 19B:
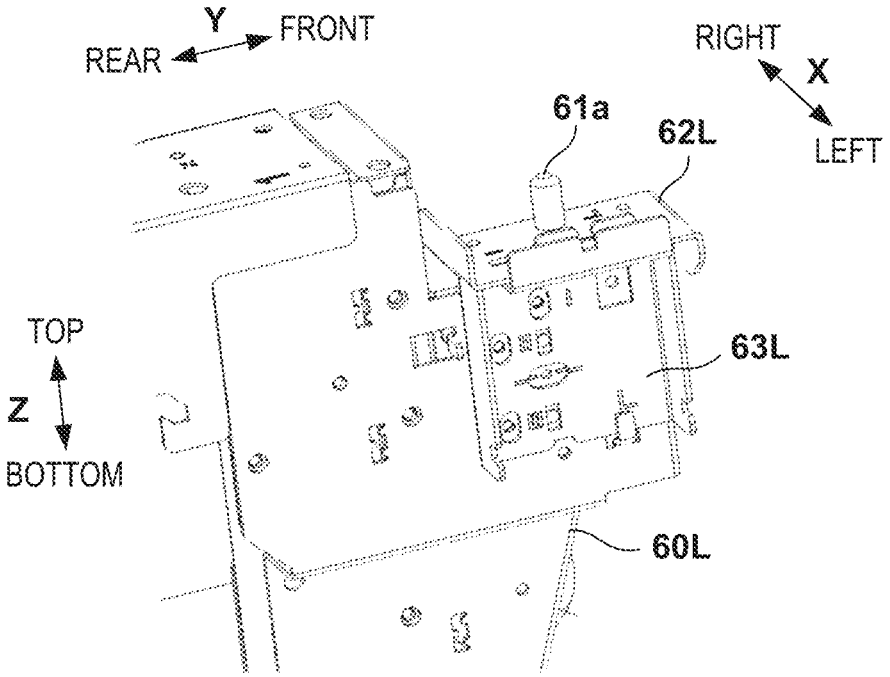

FIG. 19B is a perspective view of the position adjustment mechanism 61L. The position adjustment mechanism 61L includes an adjustment member 62L on which the reference portion 61*a* stands, and an adjustment member 63L. The adjustment members 62L and 63L have the configuration similar to that of the adjustment members 62R and 63R of the position adjustment mechanism 61R, and a detailed description thereof will be omitted. By individually adjusting the Y-direction position and the Z-direction position of each of the reference portions 61*a* by the position adjustment mechanisms 61R and 61L, the parallelism between the virtual line connecting the two reference portions 61*a* and the roller shaft 3*c* supporting the conveying rollers 3*a* can be adjusted.

Position Adjustment During Replacement

The discharge roller 7*a* may be replaced due to wear. As replacement modes of the discharge roller 7*a*, replacement on the basis of the discharge roller unit 40 and replacement on the basis of the unit including the discharge rollers 7*a* and the roller shaft 42 are conceivable. Once the positioning between the stay 30 and the discharge roller unit 40 is performed using the position adjustment mechanism 50, it is unnecessary to perform position adjustment again as long as the replacement operation is performed while the position adjustment mechanism 50 is fixed to the side plate 31R. Accordingly, the replacement workability can be improved. In this manner, the exit path can be easily adjusted with respect to the conveying rollers. The reversing unit 1B can also be replaced due to wear or failure. Once the positioning between the reference portions 61*a* and the roller shaft 3*c* of the conveying rollers 3*a* is performed using the position adjustment mechanisms 60R and 60L, it is unnecessary to perform position adjustment again every time the reversing unit 1B is replaced. Accordingly, the replacement workability can be improved.

Replacement Structure for Roll Sheet

Figure 20:
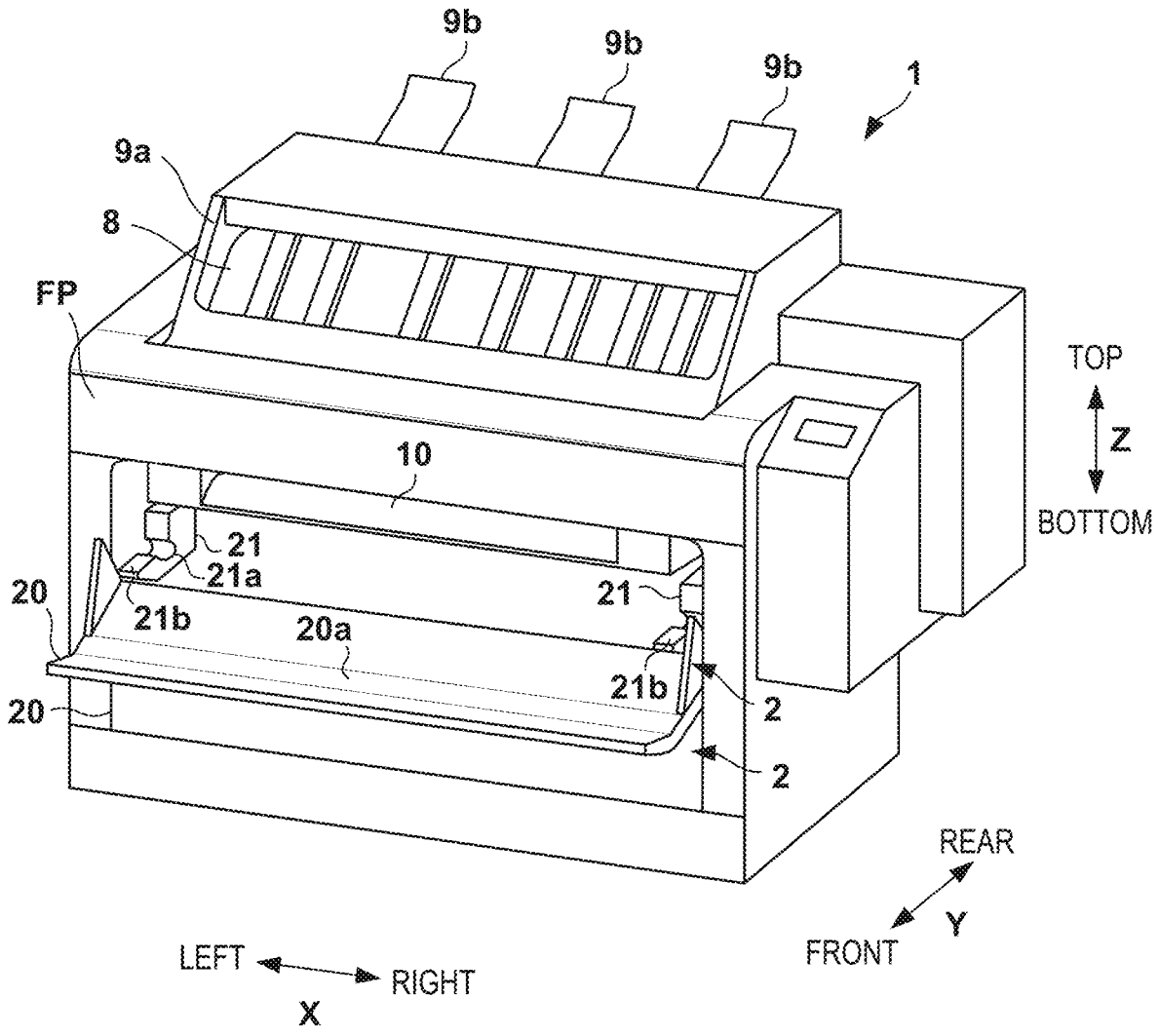
FIG. 20 is an external perspective view of the printing apparatus with the door open.
Figure 21A:
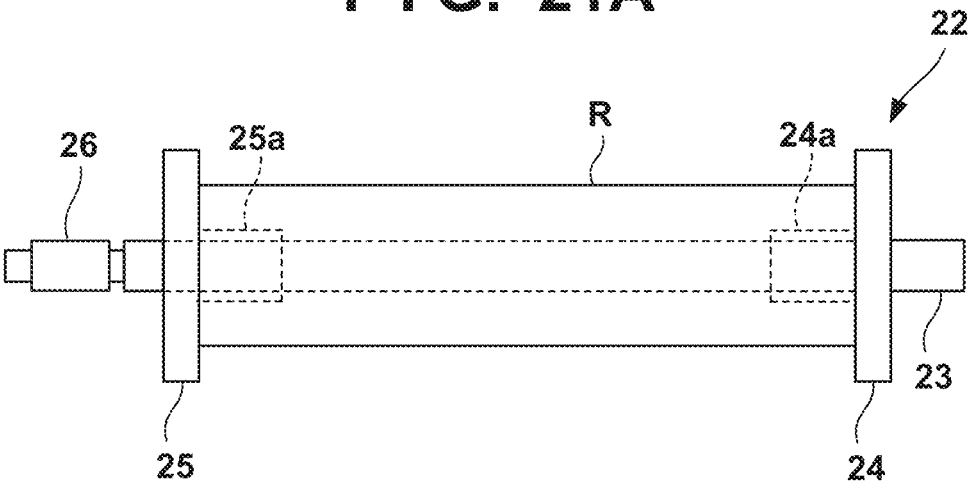
FIGS. 21A and 21B are views for explaining a holder of a roll sheet.
Figure 21B:
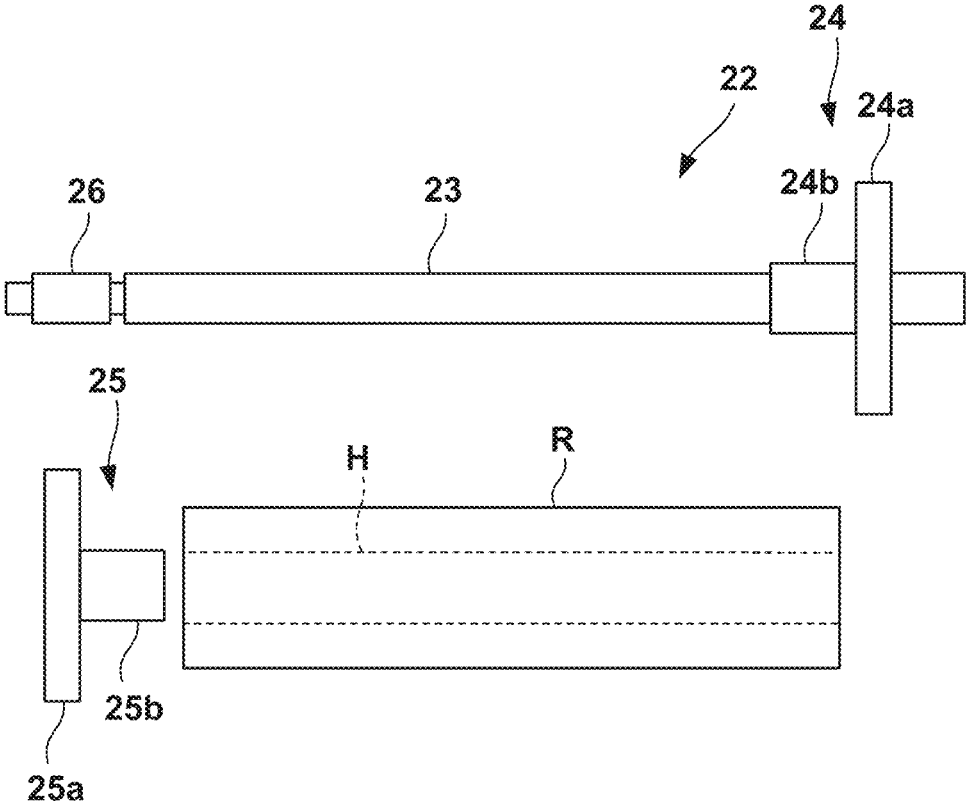

With reference to FIGS. 20 to 23, the replacement structure for the roll sheet R will be described. FIG. 20 is a perspective view of the printing apparatus 1 showing a state in which the door 20 of one feeding unit 2 of the two feeding units 2 is open. A pair of the support portions 21 spaced apart from each other in the X direction are provided in the storage portion inside the feeding unit 2, and the roll sheet R is supported by the pair of the support portions 21 so as to be rotatable around an X-direction axis. The roll sheet R supported by a holder is rotatably supported by the pair of the support portions 21. FIG. 21A shows the roll sheet R with a holder 22 attached thereto, and FIG. 21B is an exploded view of the holder 22.

The holder 22 includes a shaft member 23, a flange 24, and a flange 25. The shaft member 23 is a member having a circular section, and a gear 26, to which a driving force for rotating the roll sheet R is input, is formed in one end portion of the shaft member 23 in the axial direction. The flange 24 is fixed to an end portion of the shaft member 23, and includes a large-diameter portion 24*a* having a diameter larger than that of the roll sheet R and a small-diameter portion 24*b* that fits into a hole H of a cylindrical member serving as the core of the roll sheet R. The small-diameter portion 24*b* is fixed to the core by a friction force, and the flange 24 is attached to one end portion of the roll sheet R. An end portion of the shaft member 23 projects outside the flange 24.

The shaft member 23 is inserted into the flange 25. The flange 25 is displaceable in the axial direction with respect to the shaft member 23. The flange 25 also includes a large-diameter portion 25*a* having a diameter large than that of the roll sheet R and a small-diameter portion 25*b* that fits into the hole H of the cylindrical member serving as the core of the roll sheet R. The small-diameter portion 25*b* is fixed to the core by a friction force, and the flange 25 is attached to the other end portion of the roll sheet R. The diameters of the large-diameter portion 25*a* and the small-diameter portion 25*b* are equal to those of the large-diameter portion 24*a* and the small-diameter portion 24*b*, respectively.

Since the position of the flange 25 in the axial direction with respect to the shaft member 23 can be changed, the common holder 22 can support the roll sheets R of different widths. In this case, since the position of the flange 24 in the axial direction with respect to the shaft member 23 is unchanged, the flange 24 serves as a reference member for defining the position of one end portion (the right end portion in this embodiment) of each of the roll sheets R of different widths. That is, with respect to the feeding unit 2, the position of the right end portion of the roll sheet R is unchanged regardless of the width of the roll sheet R, and a sheet pulled out from the roll sheet R is offset to the right end portion of the conveyance path RT and conveyed therein. The printing position of an image on the sheet may be determined using the right end portion of the sheet as a reference.

Figure 22A:
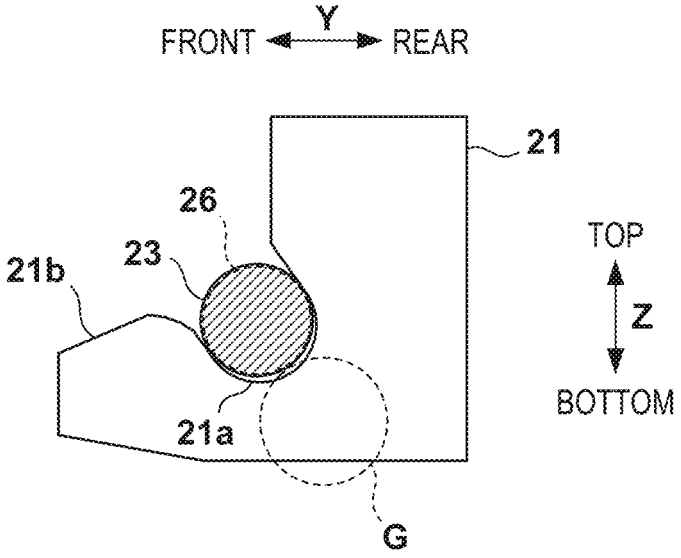
FIG. 22A is a view for explaining a support portion.

FIG. 22A shows the structure of the support portion 21. The support portion 21 includes a groove 21*a* into which the shaft member 23 is inserted in the radial direction. The depth direction of the groove 21*a* is oblique to the Z direction, and the bottom portion of the groove 21*a* has a semi-circular sectional shape. The shaft member 23 is bridged over the pair of support portions 21 and supported so as to be rotatable within the groove 21*a*. The large-diameter portion 24*a* of the flange 24 and the large-diameter portion 25*a* of the flange 25 are located on the inner sides of the support portions 21 (between the pair of support portions 21). When the shaft member 23 is mounted in the groove 21*a*, the gear 26 meshes with a gear G. The gear G is a gear forming the feeding mechanism, and a driving force of a driving source (motor) of the feeding mechanism is transmitted to the gear 26 through the gear G. A driving force for rotating the roll sheet R is input to the gear 26 from the feeding mechanism, and this driving force causes the roll sheet R to rotate forward or backward. Thus, feeding or winding up of the sheet is performed.

Figure 22B:
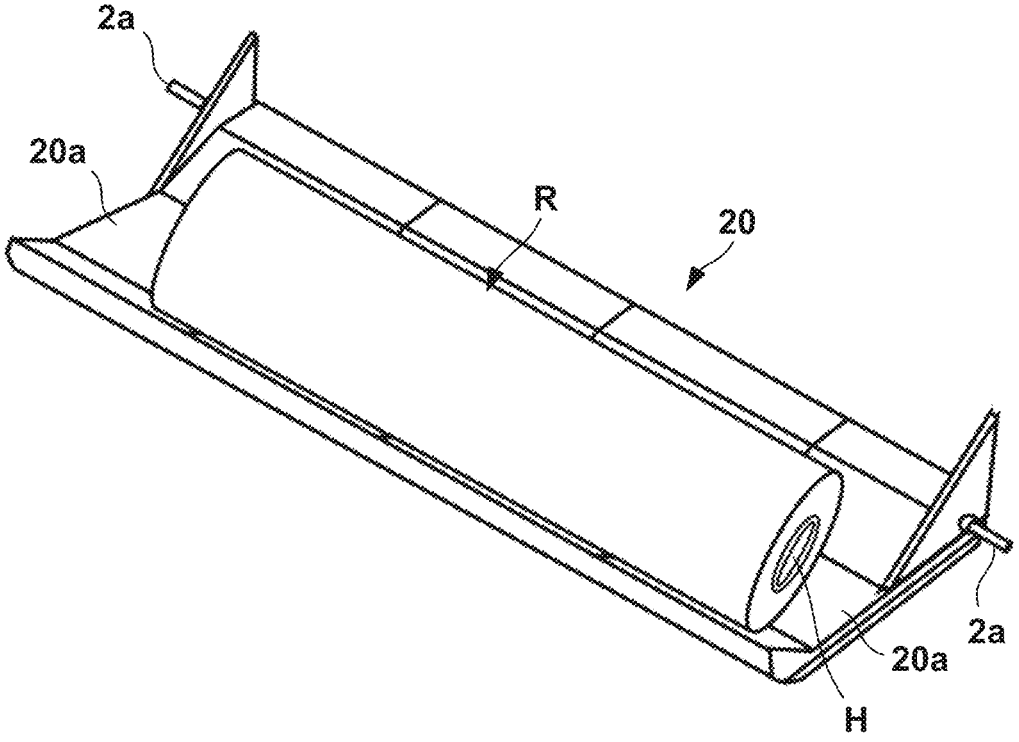
FIG. 22B is a view for explaining a recess portion of the door.

A recess portion 20*a*, which enables the roll sheet R to be placed on the door 20 when the door 20 is in the open state, is formed in the inner surface of the door 20. The recess portion 20*a* is located in the center in the Y direction in the open state of the door 20, and formed by the Y-direction front end portion and the Y-direction rear end portion being inclined toward the central portion. FIG. 22B exemplarily shows a state in which the roll sheet R is placed in the recess portion 20*a*.

Figure 23:
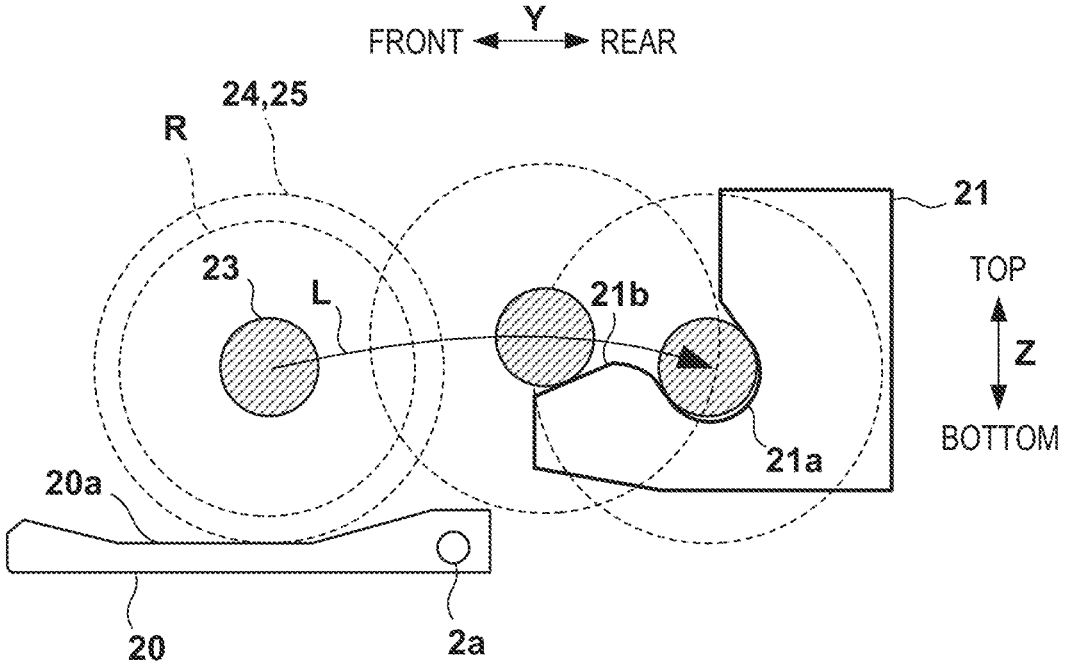
FIG. 23 is a view for explaining a roll sheet replacement mode.

When replacing the roll sheet R, the new roll sheet R with the holder 22 attached thereto is temporarily placed in the recess portion 20*a*. Then, the roll sheet R is rolled to the support portions 21 together with the holder 22. Thus, the new roll sheet R can be easily set in the support portions 21. FIG. 23 is a view for explaining this.

The large-diameter portions 24*a* and 25*a* of the flanges 24 and 25 abut against the recess portion 20*a*. When the roll sheet R is rolled to the support portions 21 together with the holder 22, the flanges 24 and 25 ride on the inclination of the rear end portion of the door 20. By further rolling the roll sheet R, the shaft member 23 rides on an inclined surface 21*b* of the front portion of each support portion 21. That is, it is designed such that the Z-direction distance from the rear end portion of the door 20 to the inclined surface 21*b* corresponds to the difference between the radius of each of the large-diameter portions 24*a* and 25*a* and the radius of the shaft member 23. Accordingly, when the roll sheet R is rolled from the recess portion 20*a* to the support portions 21 together with the holder 22, the shaft member 23 is moved along a locus L and the shaft member 23 drops into the groove 21*a*. Thus, the user can easily perform setting work of the roll sheet R.

Further, since this embodiment employs the structure in which the stay 30 serving as the skeleton of the reversing unit 1B is located at the top of the unit and connected with the main body 1A, it is possible to ensure a larger space below the reversing unit 1B, so that a large space for a replacement operation of the roll sheet R by the user can be ensured. Therefore, the user operability can be improved.

Other Embodiments

In the embodiment described above, the arrangement has been exemplarily shown in which two exit paths (RT1 and RT2) are provided, but three or more exit paths may be provided. Further, although the reversing portion 11 is provided in the exit path RT1, the reversing portion may be provided in the exit path RT2. Furthermore, in the embodiment described above, the example has been described in which the guide member 12 as the openable and closable member opens and closes one exit path RT1, but the openable and closable member may be a member that opens and closes a plurality of exit paths.

Although embodiments of the present invention have been described above, the present invention is not limited to the above embodiments and various changes and modifications can be made within the spirit and scope of the present invention. Therefore, to apprise the public of the scope of the present invention, the following claims are made.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-197309, filed Nov. 27, 2020, which is hereby incorporated by reference herein in its entirety.

What is claimed is:

1. A printing apparatus comprising:

a printing unit configured to print an image on a print medium;

a first exit path from which the print medium with the image printed thereon by the printing unit is discharged after being reversed;

a second exit path from which the print medium with the image printed thereon by the printing unit is discharged without being reversed;

a switch member configured to be pivotable about a shaft so as to switch between the first exit path and the second exit path, and including a first surface preventing the print medium from entering the second exit path when the first exit path is selected, and a second surface preventing the print medium from entering the first exit path when the second exit path is selected; and a guide member including a third surface configured to form the first exit path;

wherein the first exit path passes above the shaft, and the second exit path passes below the shaft, and wherein the guide member is configured to be pivotable about the shaft so as to open and close the first exit path.

2. The apparatus according to claim 1, further comprising a driving unit including a motor as a driving source, and configured to cause the switch member to pivot.

3. The apparatus according to claim 1, wherein one of the first exit path and the second exit path is an exit path from which the print medium is discharged to a rear side with respect to a front-and-rear direction of the printing apparatus, and the other one is an exit path from which the print medium is discharged to a front side with respect to the front-and-rear direction.

4. The apparatus according to claim 1, wherein the first exit path includes a reversing portion where the print medium is reversed, and a stacking portion on which the print medium reversed in the reversing portion is stacked, and the print medium is stacked on the stacking portion in a manner in which the lower surface of the print medium is a printed surface printed by the printing unit.

5. The apparatus according to claim 1, further comprising:

a main body; and an attachment/detachment unit configured to be detachably attached to the main body, and including the switch member and the guide member, wherein the attachment/detachment unit is provided with a discharge roller unit which is located in the first exit path and is configured to convey the print medium.

6. The apparatus according to claim 5, wherein the attachment/detachment unit is provided with a roller position adjustment unit including a first adjustment member configured to adjust a position of the discharge roller unit in a first direction and a second adjustment member configured to adjust the position of the discharge roller unit in a second direction intersecting the first direction.

7. The apparatus according to claim 6, wherein the attachment/detachment unit is provided with a driving unit including a motor as a driving source, the discharge roller unit includes a roller shaft and a roller supported by the roller shaft, a driving force of the driving unit is input to one end portion of the roller shaft, and the roller position adjustment unit is configured to adjust a position of the other end portion of the roller shaft.

8. The apparatus according to claim 7, wherein the roller position adjustment unit is configured to adjust the position of the other end portion of the roller shaft in the first direction and the second direction intersecting an axial direction of the roller shaft.

9. The apparatus according to claim 5, further comprising:

a unit position adjustment mechanism configured to adjust an attachment position of the attachment/detachment unit with respect to the main body, wherein the main body is provided with a conveying unit configured to convey the sheet to the printing unit.

10. The apparatus according to claim 9, wherein the attachment/detachment unit includes:

a stay extending in a widthwise direction of the print medium, and side plates provided at respective end portions of the stay with respect to the widthwise direction, the discharge roller unit is configured to be supported between the side plates, and the attachment/detachment unit is configured to be attached/detached to/from the main body through the stay.

11. The apparatus according to claim 1, further comprising:

a storage portion configured to store a roll sheet as the print medium, wherein the roll sheet is supported by a holder, and the storage portion is provided with a pair of support portions spaced apart from each other in an axial direction of the roll sheet and configured to pivotably support the roll sheet through the holder.

12. The apparatus according to claim 11, wherein the holder includes:

a shaft member configured to be inserted into the roll sheet in the axial direction, a first flange configured to be attached to one end portion of the roll sheet with respect to the axial direction and be fixed to the shaft member, and a second flange configured to be attached to the other end portion of the roll sheet with respect to the axial direction and be displaceable in the axial direction with respect to the shaft member.

13. The apparatus according to claim 12, wherein the support portion includes a groove into which the shaft member is inserted in a radial direction.

14. The apparatus according to claim 12, wherein one end portion of the shaft member is provided with a gear to which a driving force for rotating the roll sheet is input.

15. The apparatus according to claim 11, wherein the storage portion includes an openable and closable door, and the door includes a recess portion in which the roll sheet is placed in an open state.

16. The apparatus according to claim 1, wherein the printing unit includes a printing head configured to discharge ink onto the print medium.

* * * * *